US012808174B2

(12) United States Patent
Matsumoto et al.

(10) Patent No.: US 12,808,174 B2
(45) Date of Patent: Nov. 24, 2026

(54) TOILET APPARATUS

(71) Applicant: AS America, Inc., Piscataway, NJ (US)

(72) Inventors: Hitomi Matsumoto, Tokyo (JP); Hiroaki Watanabe, Tokyo (JP); Michitarou Maki, Tokyo (JP); Masashi Kusume, Tokyo (JP)

(73) Assignee: LIXIL Corporation, Tokyo (JP)

( * ) Notice: Subject to any disclaimer, the term of this patent is extended or adjusted under 35 U.S.C. 154(b) by 78 days.

(21) Appl. No.: 18/690,205

(22) PCT Filed: Jun. 23, 2022

(86) PCT No.: PCT/JP2022/025187

§ 371 (c)(1),
(2) Date: Mar. 7, 2024

(87) PCT Pub. No.: WO2023/037700

PCT Pub. Date: Mar. 16, 2023

(65) Prior Publication Data

US 2024/0401322 A1 Dec. 5, 2024

(30) Foreign Application Priority Data

Sep. 8, 2021 (JP) ..... 2021-146019
Mar. 22, 2022 (JP) ..... 2022-045678

(51) Int. Cl.
*E03D 9/10* (2006.01)
*E03D 11/11* (2006.01)

(52) U.S. Cl.
CPC ..... *E03D 9/10* (2013.01); *E03D 11/11* (2013.01)

(58) Field of Classification Search
CPC ..... E03D 9/10; E03D 11/11; B60R 15/04
See application file for complete search history.

(56) References Cited

U.S. PATENT DOCUMENTS 1,005,075 A * 10/1911 Rosenstock ..... E03D 9/10 193/17
2,401,098 A * 5/1946 Peter ..... E03D 11/10 4/348

(Continued)

FOREIGN PATENT DOCUMENTS

GB 742519 A * 12/1955 ..... E03D 5/016
JP 4025763 B1 11/1965

(Continued)

OTHER PUBLICATIONS

Written Opinion of the International Searching Authority, for PCT/JP2022/025187, mail date Aug. 30, 2022, with English translation.

(Continued)

*Primary Examiner* — Erin Deery
(74) *Attorney, Agent, or Firm* — Anna-Lisa L. Gallo; Tyler A. Stevenson

(57) ABSTRACT

Provided is a compact toilet apparatus. A toilet apparatus (100) comprises: a toilet (10) having a bowl (10A) with a lower end opened to form a discharge port (10M), and a flapper valve (30B) that opens and closes the discharge port (10M); a buffer tank (18) provided below the flapper valve (30B); and a crushing part (12) having an inflow port (12C) communicating with a side surface of the buffer tank (18) below an upper end of the buffer tank (18) in a state where the crushing part (12) is connected to the toilet (10), the crushing part (12) crushing a solid included in sewage (Sew) stored in the buffer tank (18).

13 Claims, 20 Drawing Sheets

(56) References Cited

U.S. PATENT DOCUMENTS

| | | | | | |
|---|---|---|---|---|---|
| 3,054,117 | A | * | 9/1962 | Cella | B02C 18/0092 4/321 |
| 3,323,650 | A | * | 6/1967 | Kilbane, Jr. | E03D 9/10 241/89.4 |
| 3,446,356 | A | * | 5/1969 | May | E03D 9/10 210/197 |
| 3,699,592 | A | * | 10/1972 | Minchak | E03D 9/10 4/431 |
| 3,713,177 | A | | 1/1973 | Tufts et al. | |
| 5,987,658 | A | * | 11/1999 | Richards | E03D 5/02 4/300 |
| 2007/0240255 | A1 | | 10/2007 | Grech | |
| 2010/0229295 | A1 | | 9/2010 | Hiranuma et al. | |

FOREIGN PATENT DOCUMENTS

| | | | |
|---|---|---|---|
| JP | 5517807 | U1 | 2/1980 |
| JP | 4118126 | B1 | 10/2007 |
| JP | 4793665 | B2 | 10/2011 |
| JP | 201257390 | A | 3/2012 |

OTHER PUBLICATIONS

PCT Search report, PCT/JP2022/025187, mail date Aug. 30, 2022.
Written Opinion of the International Searching Authority, mail date Aug. 30, 2022.
Extended European Search Report for EP application No. 22867027.9, mail date Sep. 15, 2025, 9 pages.

* cited by examiner

[FIG. 1]
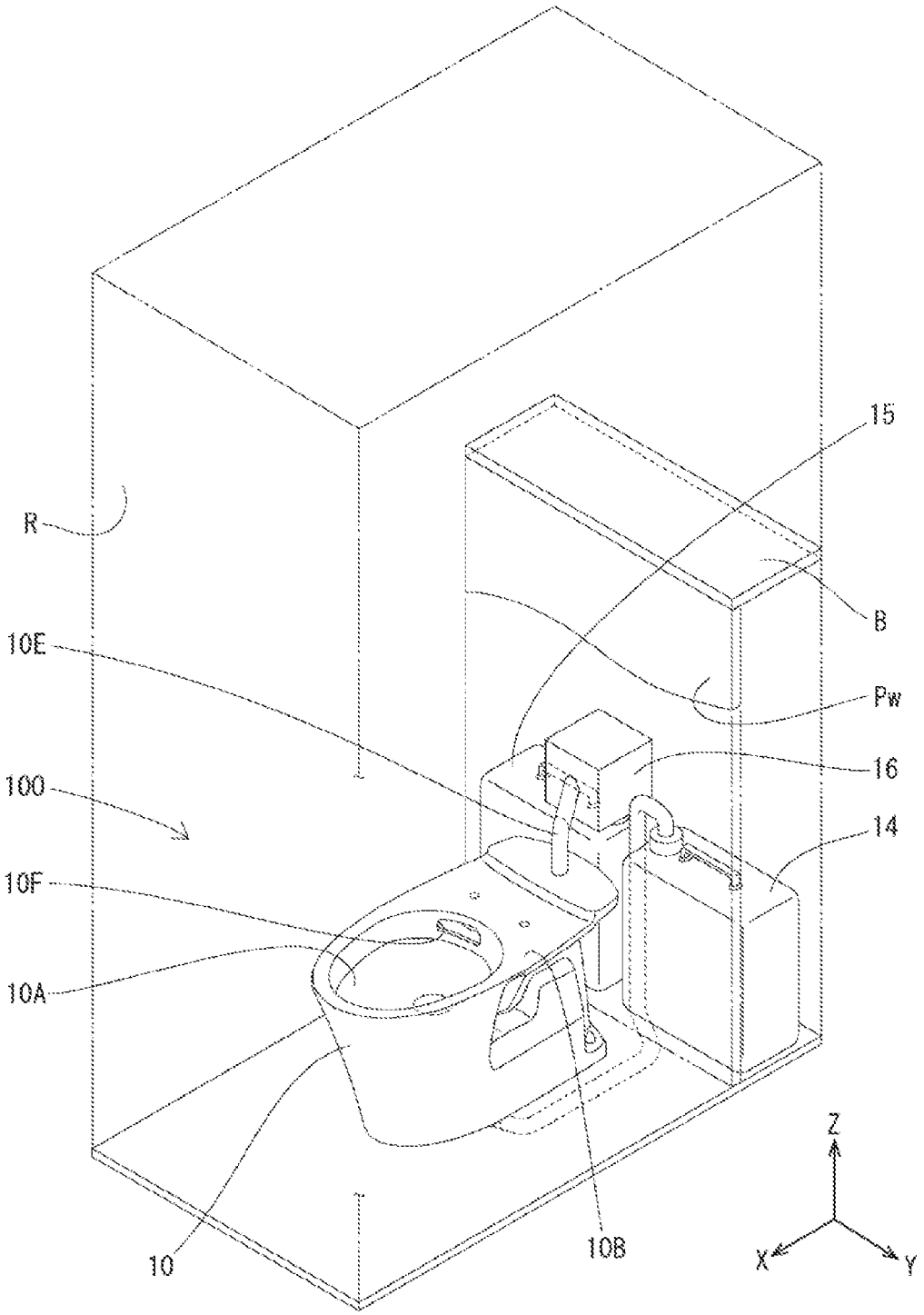

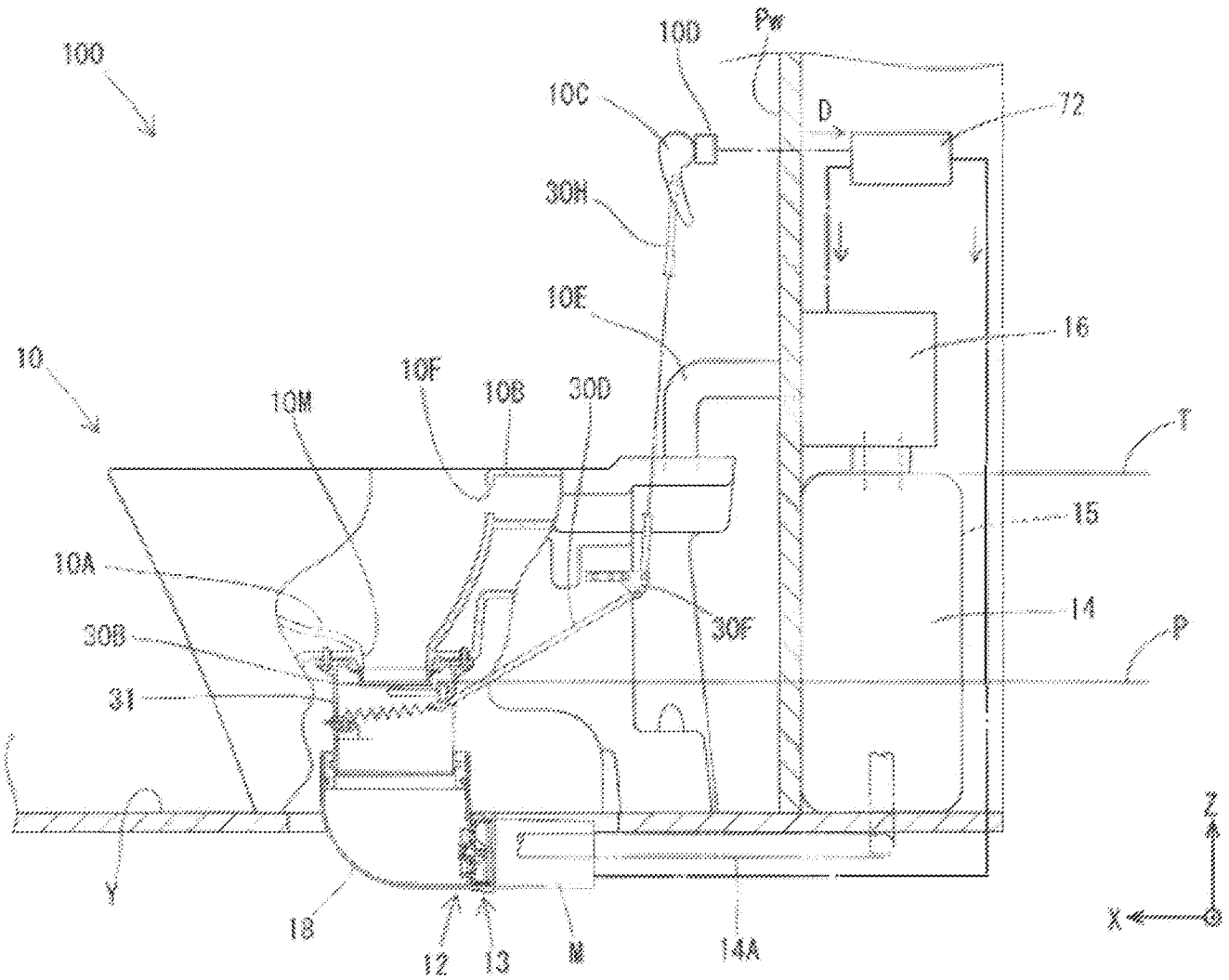
[FIG. 2]

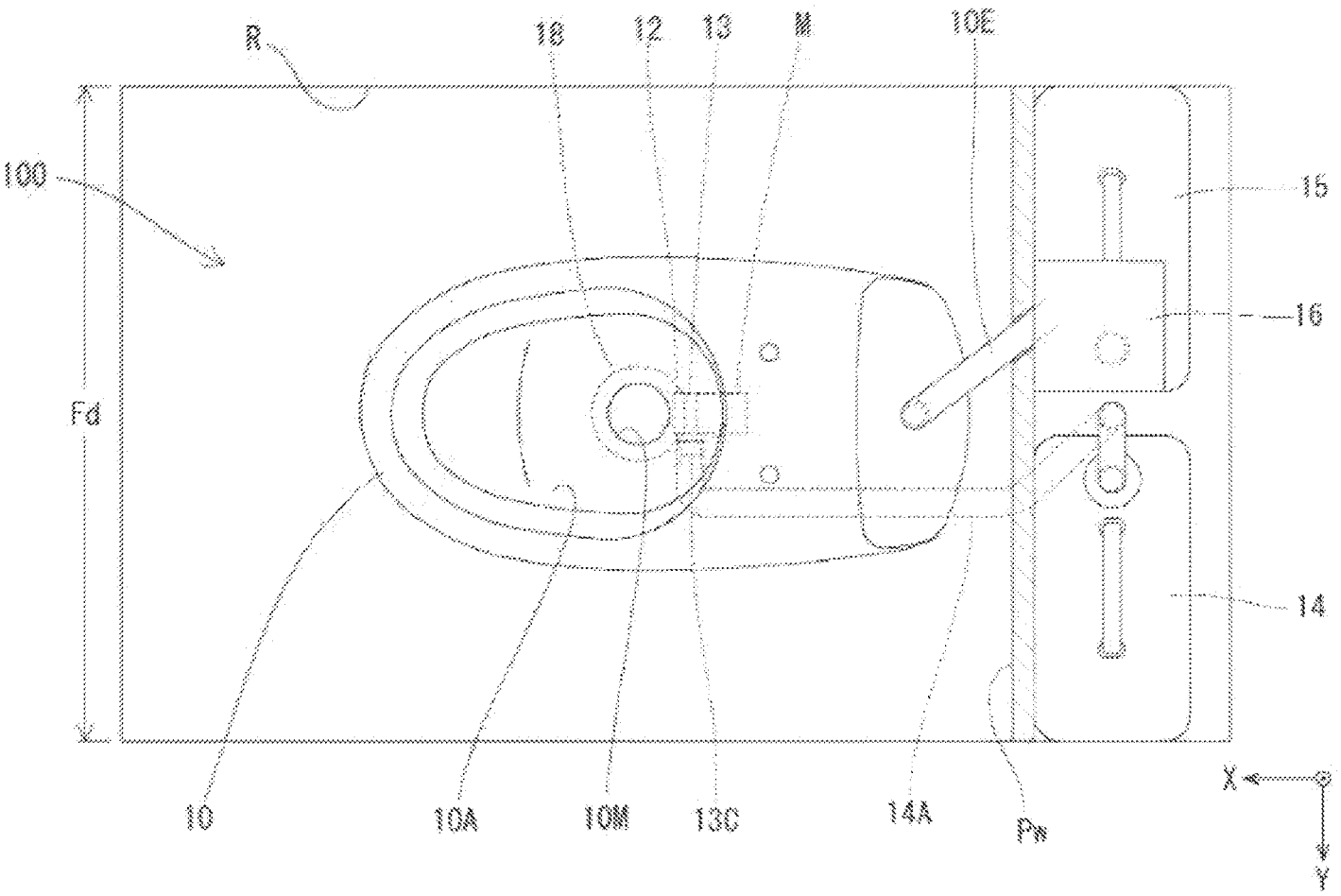
[FIG. 3]

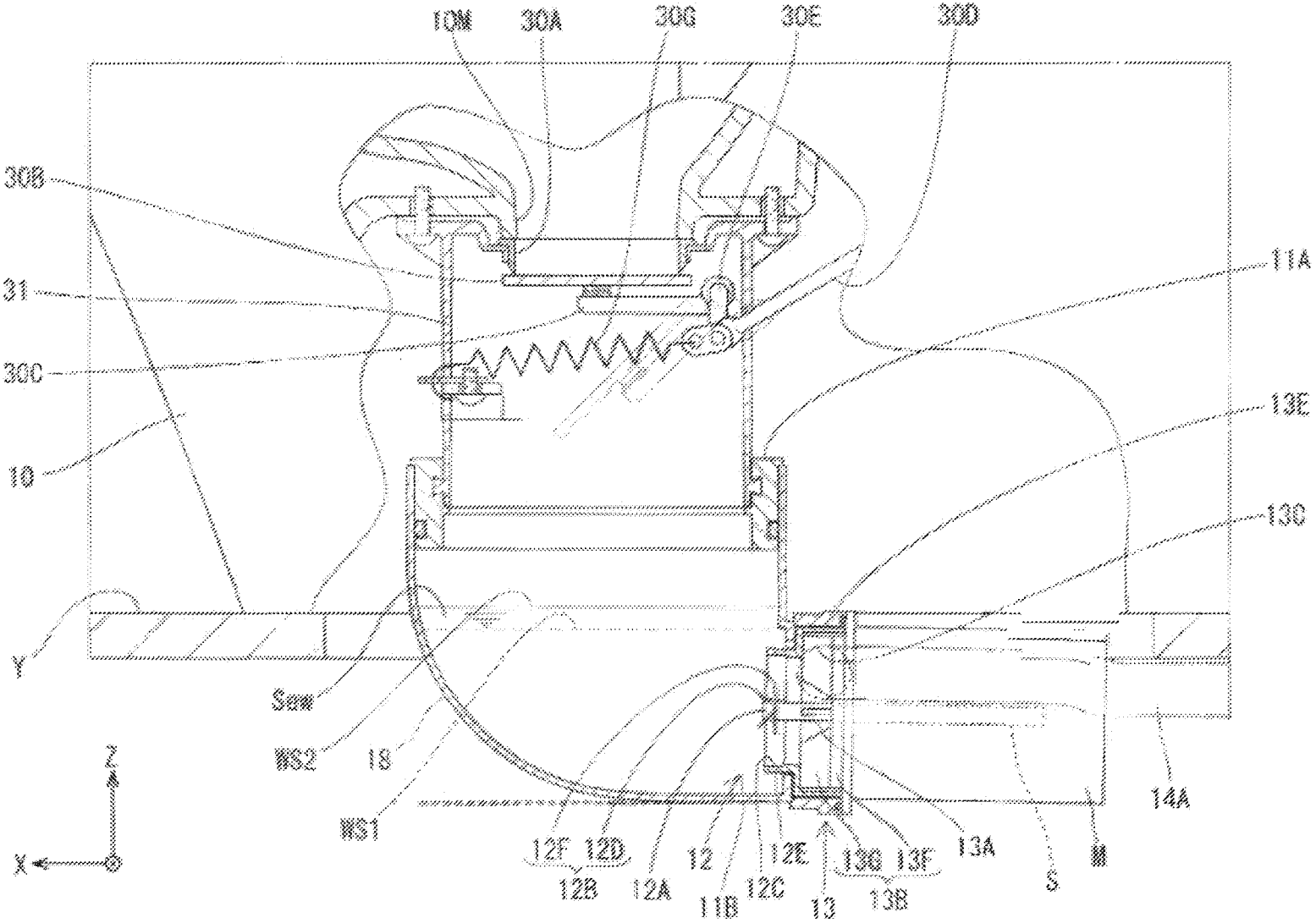
[FIG. 4]

[FIG. 5]
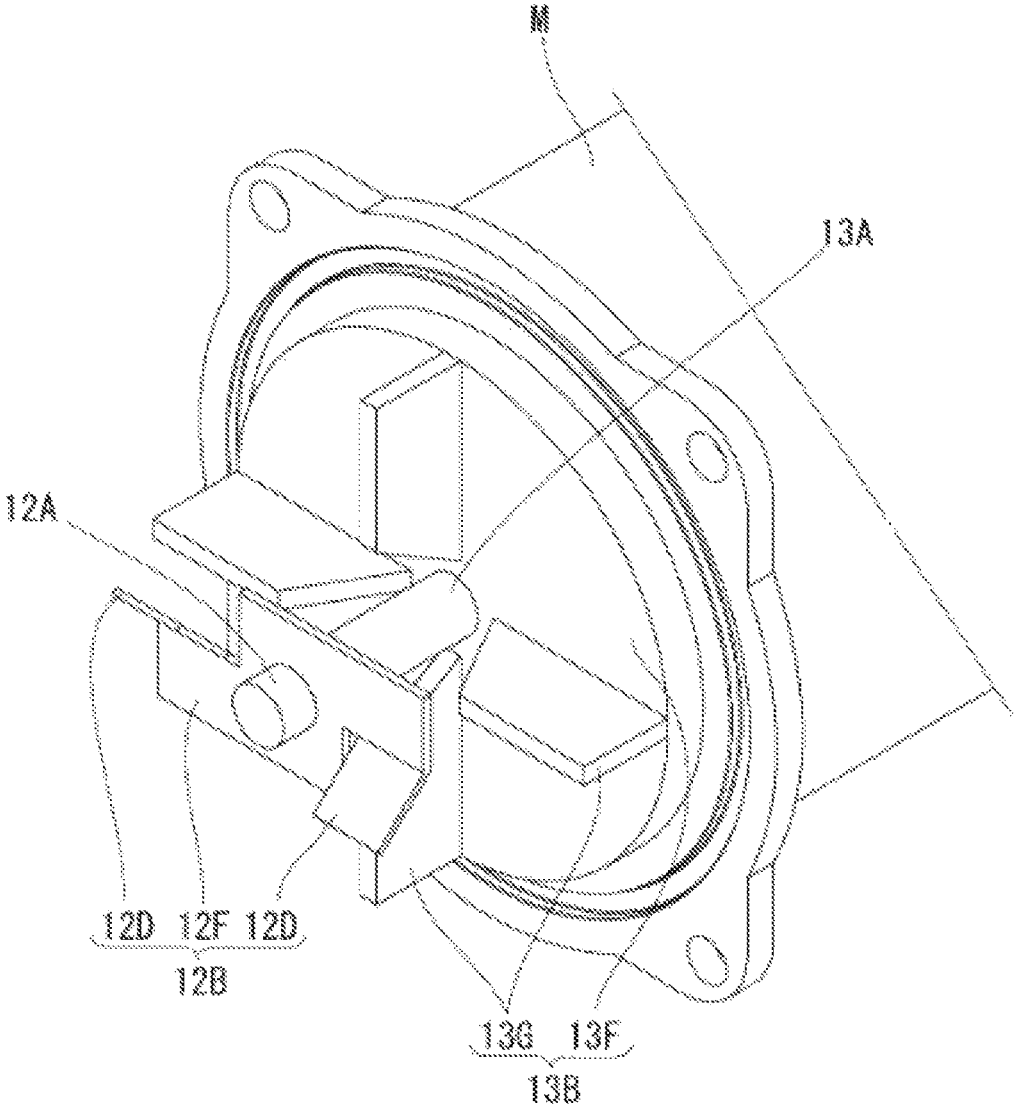

[FIG. 6]
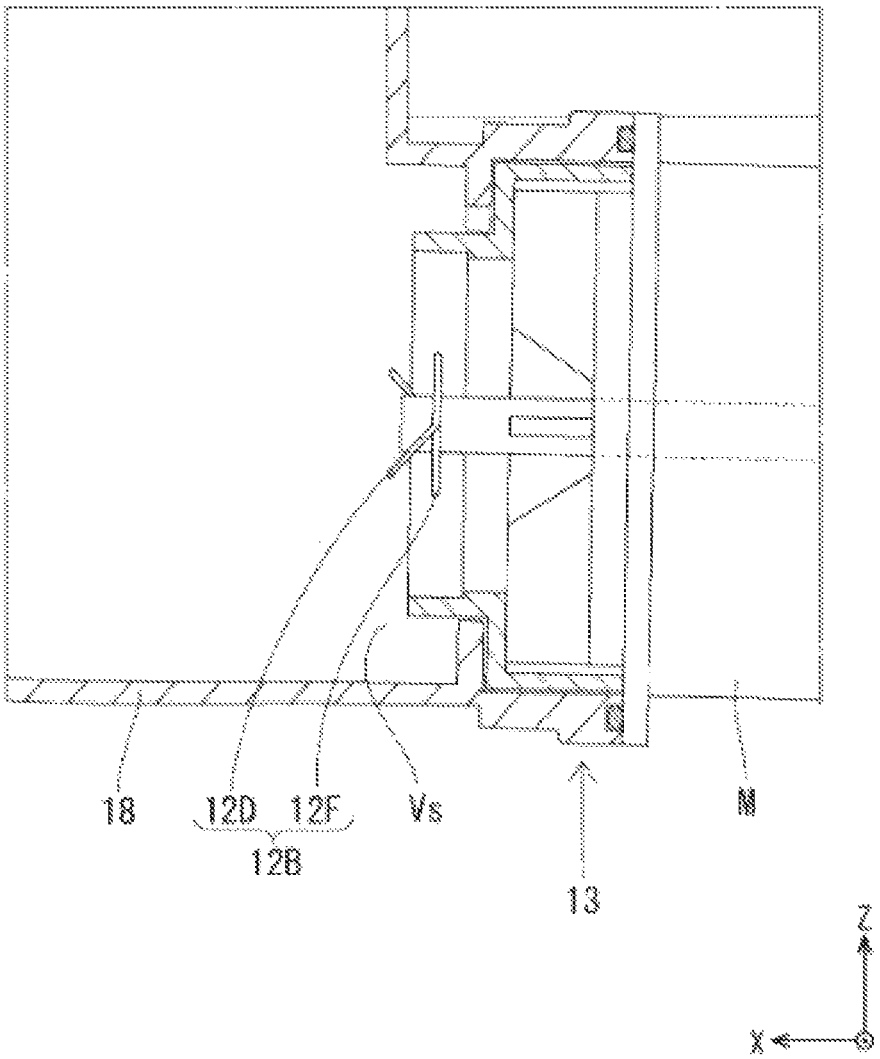

[FIG. 7]
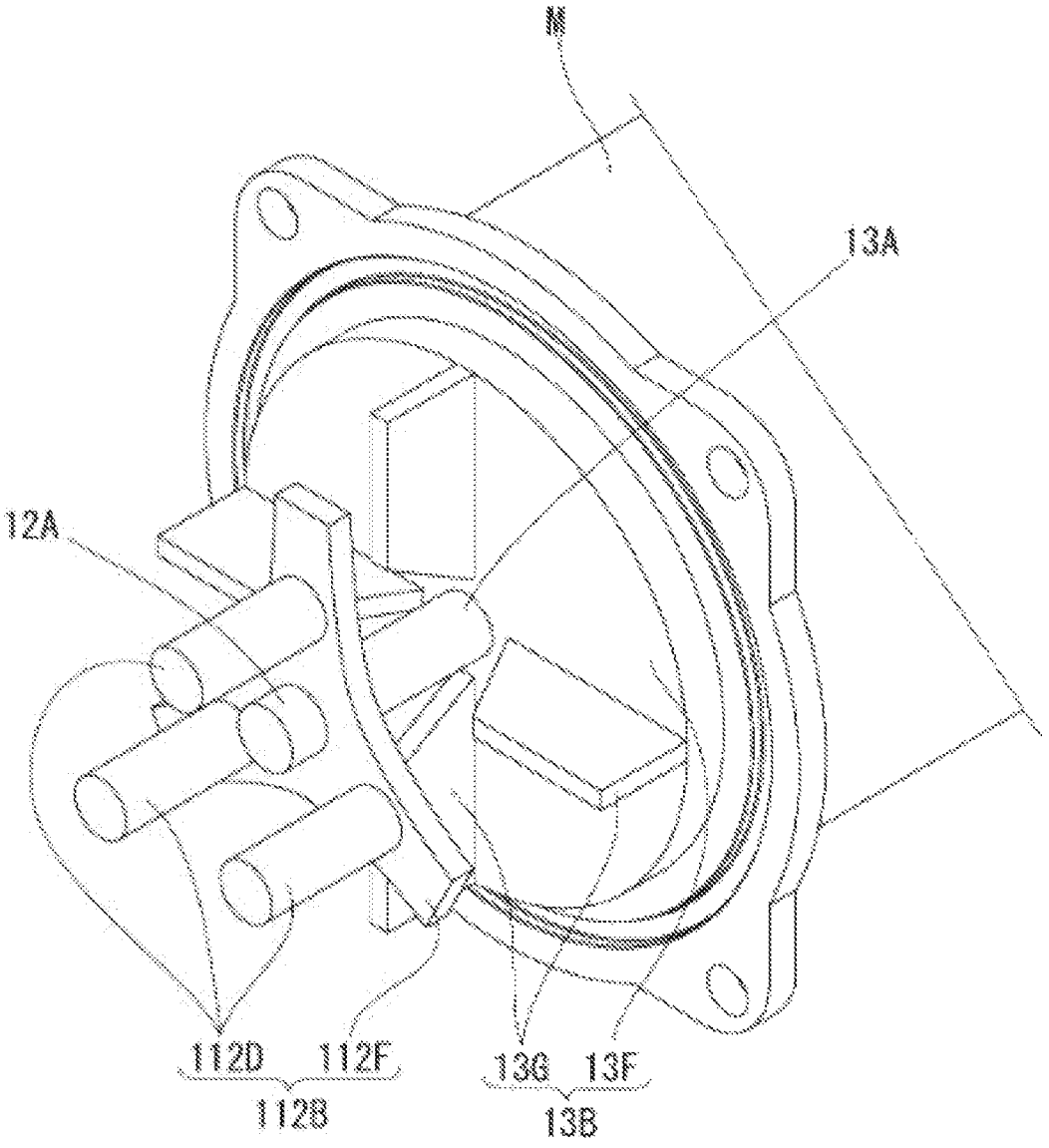

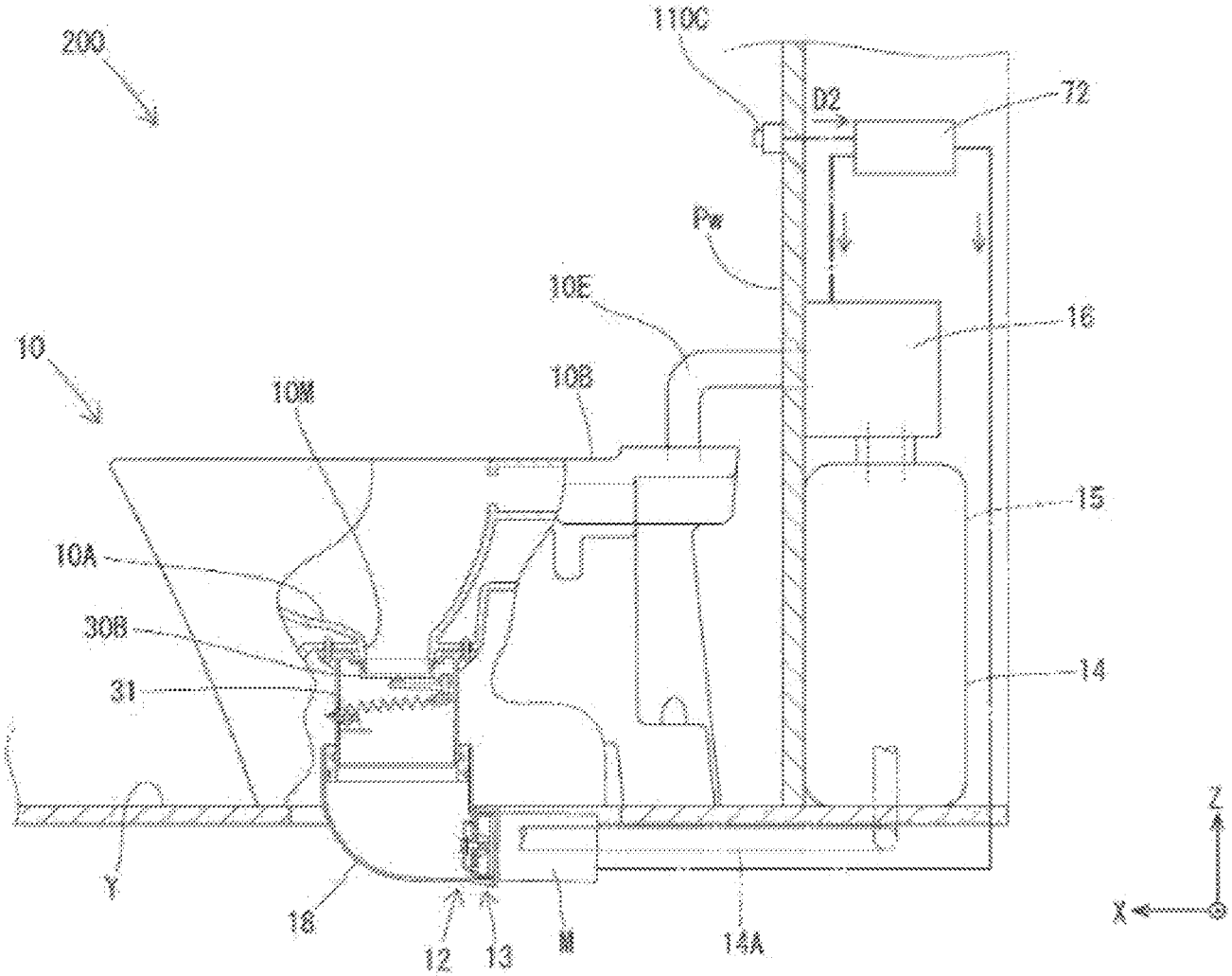
[FIG. 8]

[FIG. 9]
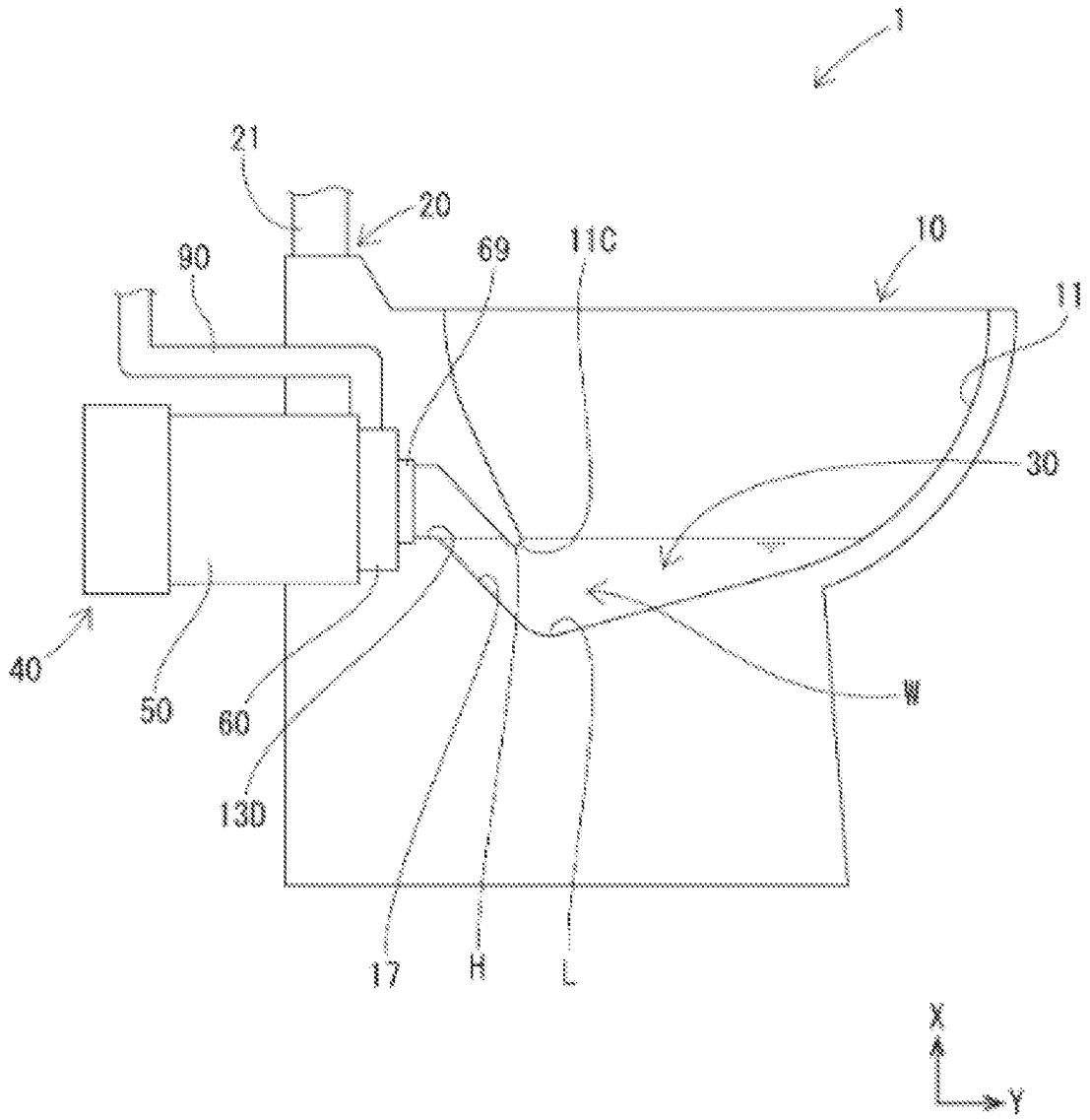

[FIG. 10]
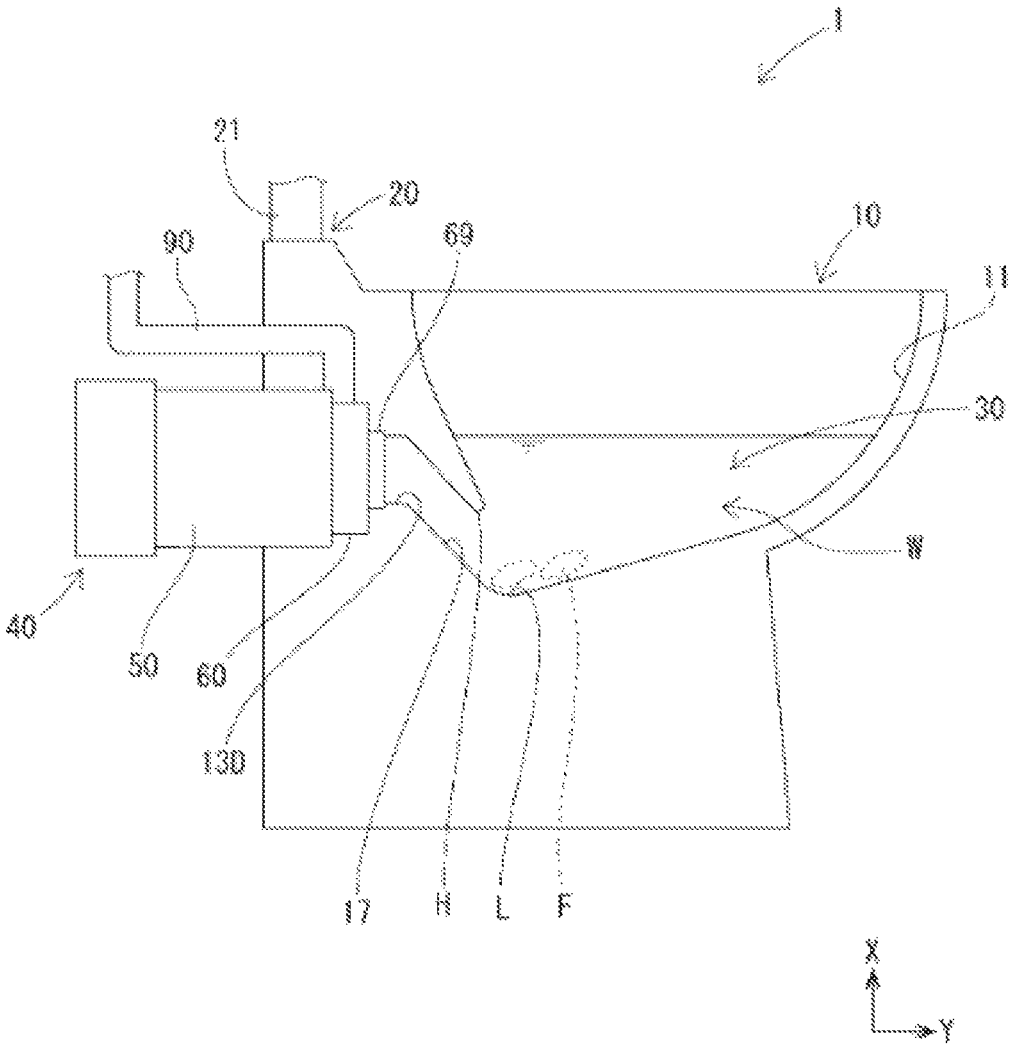

[FIG. 11]
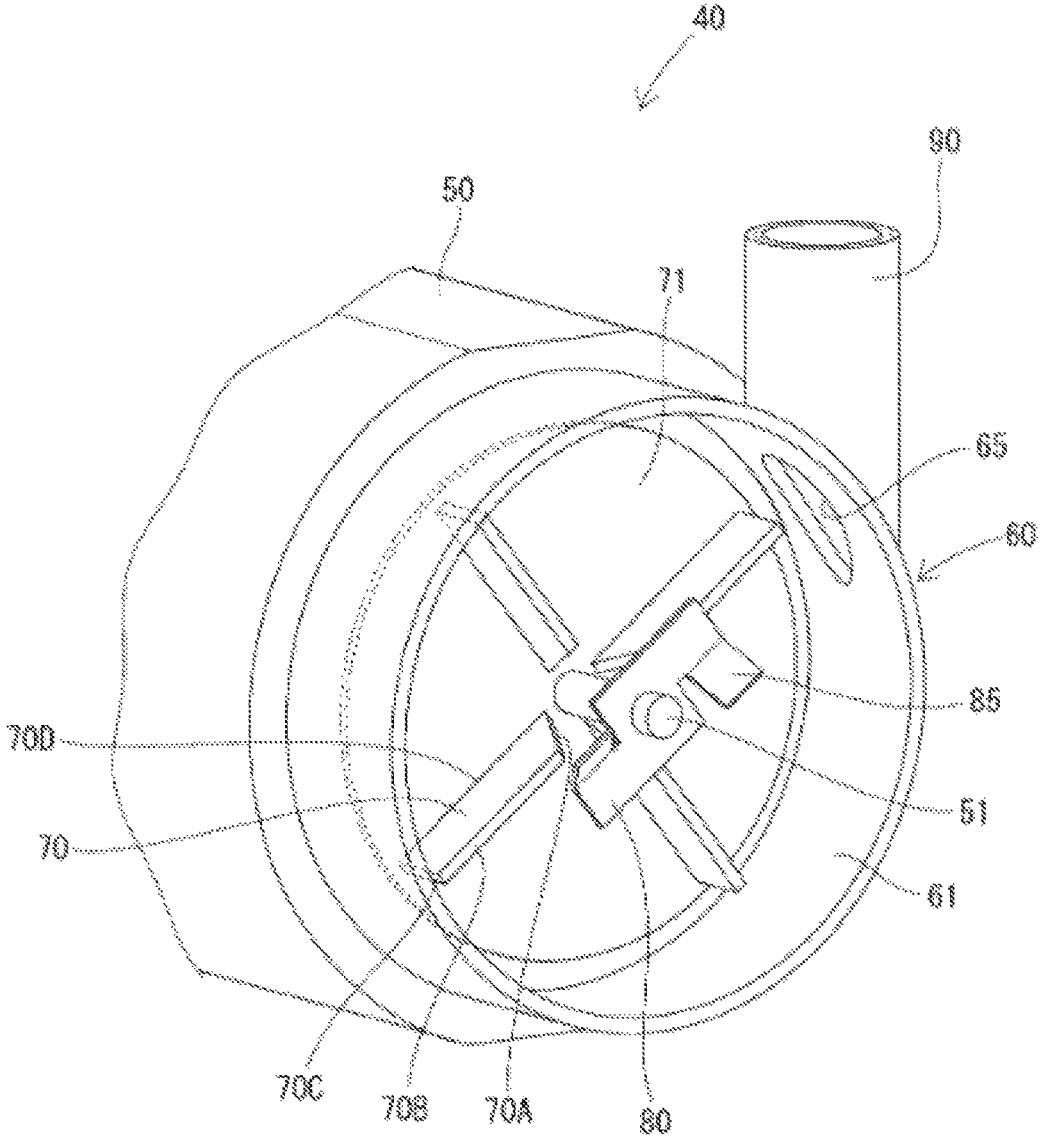

[FIG. 12]
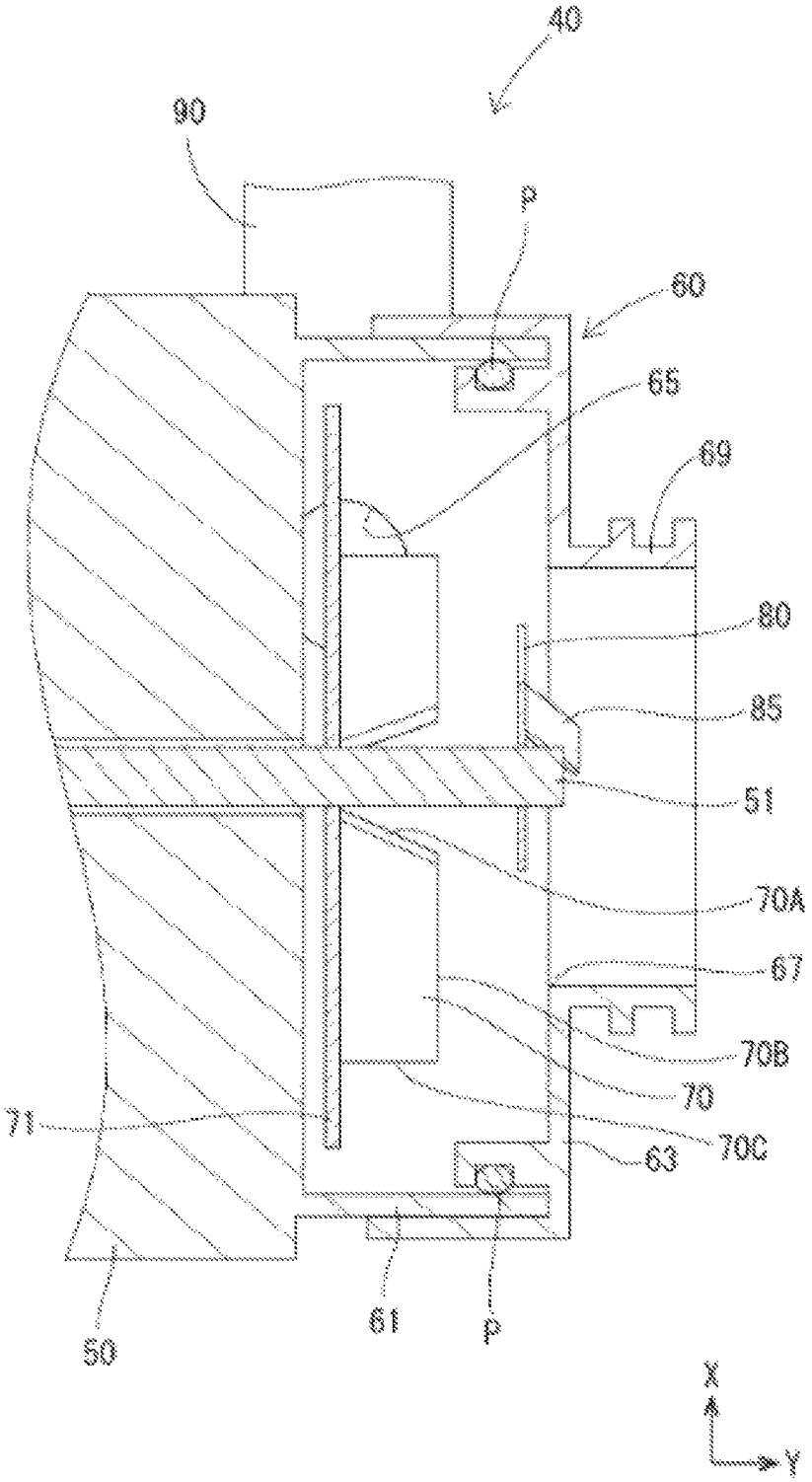

[FIG. 13]
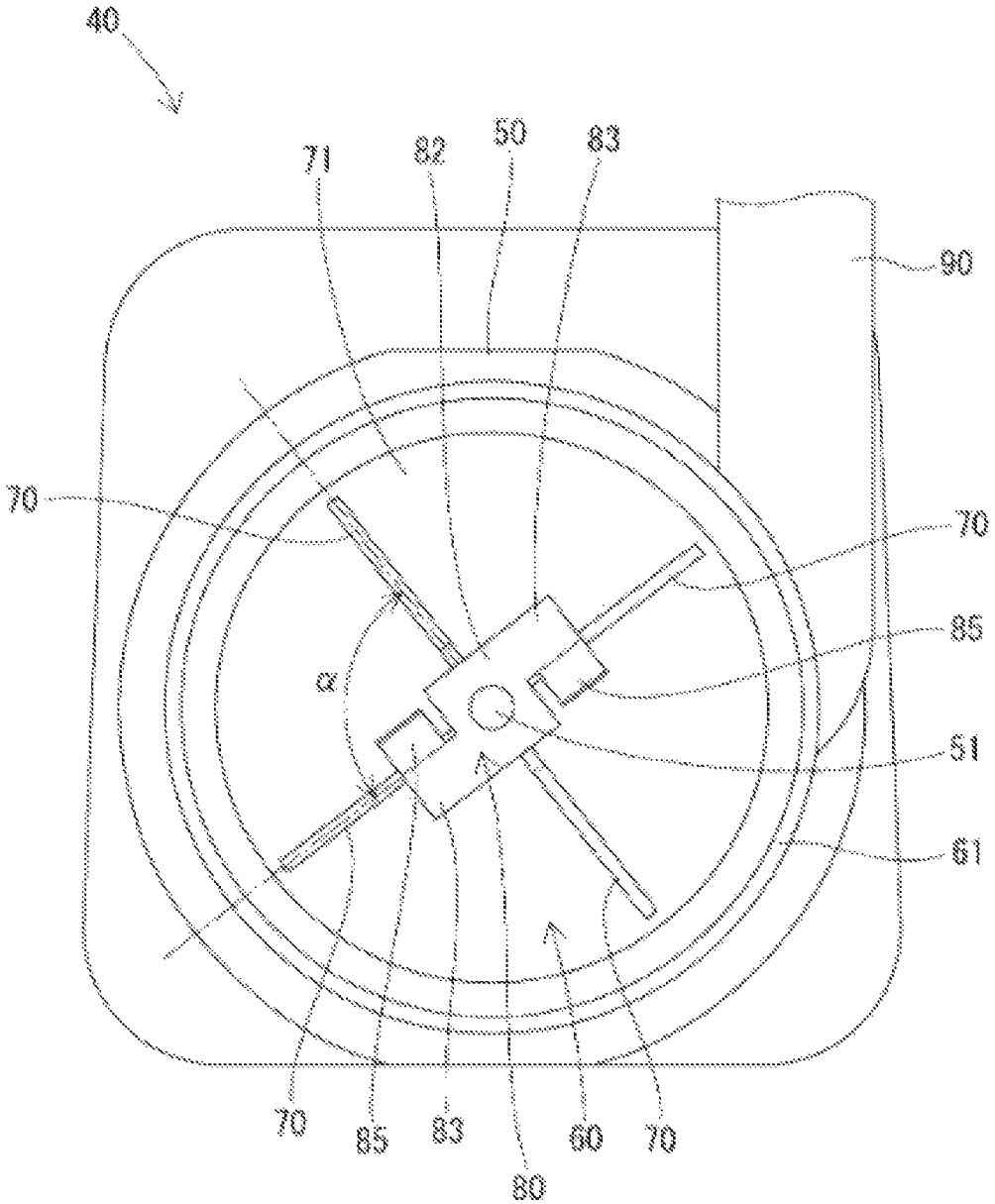

[FIG. 14]
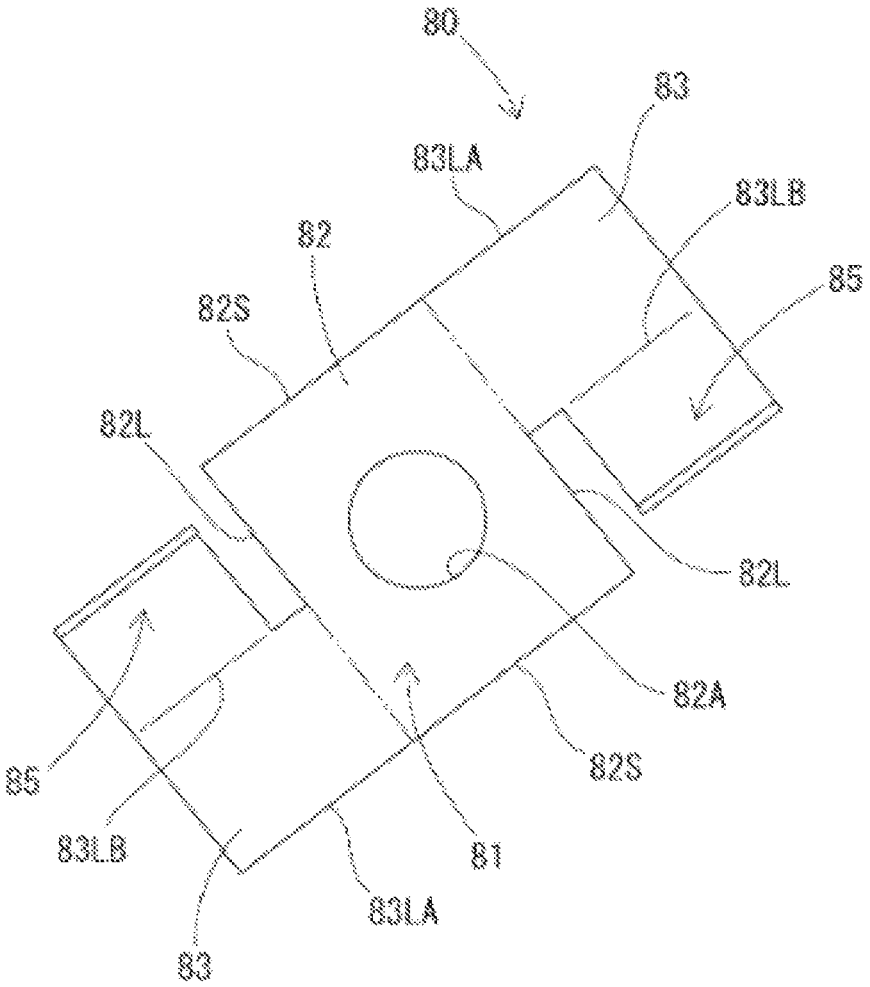

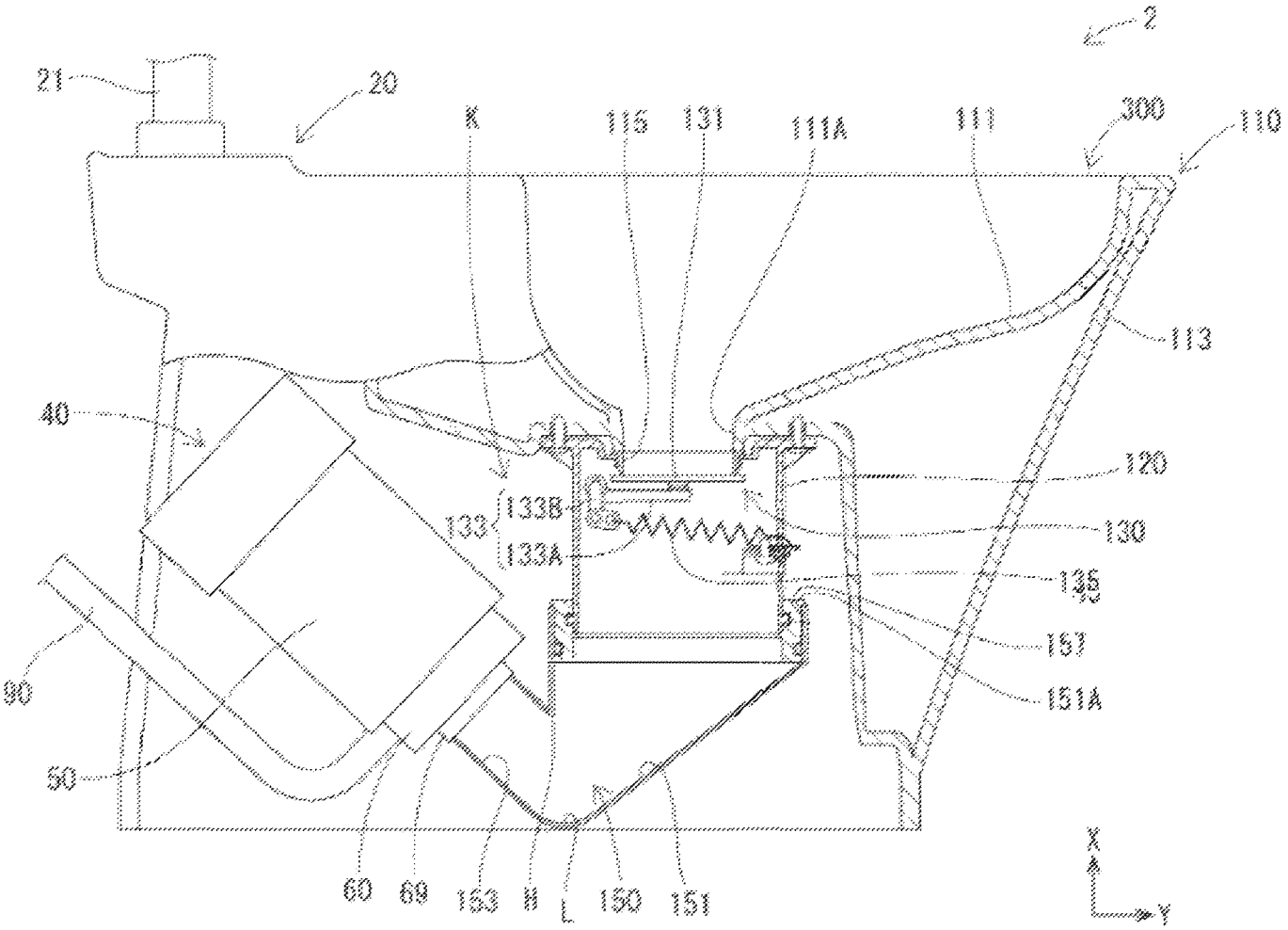
[FIG. 15]

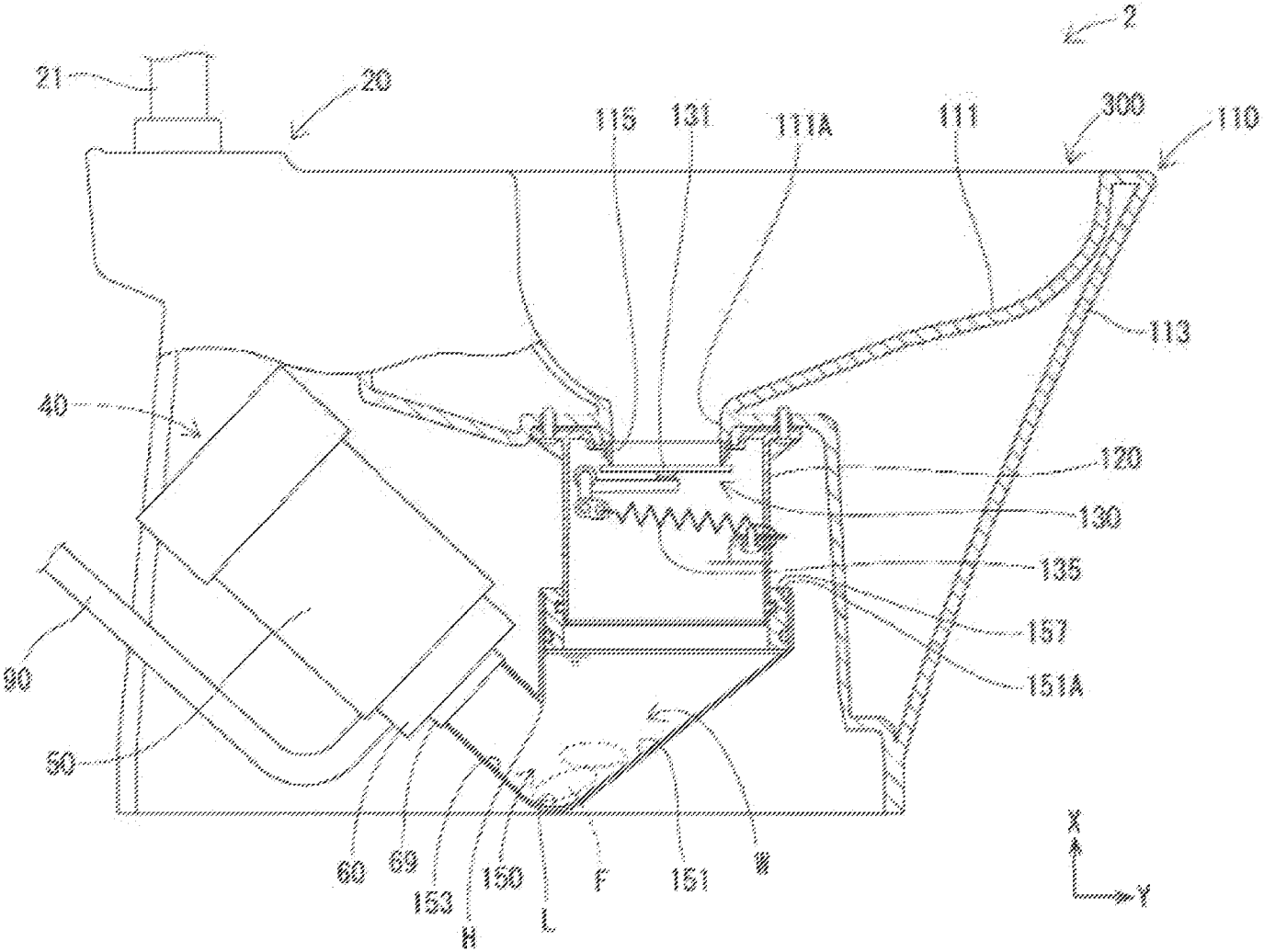
[FIG. 16]

[FIG. 17]
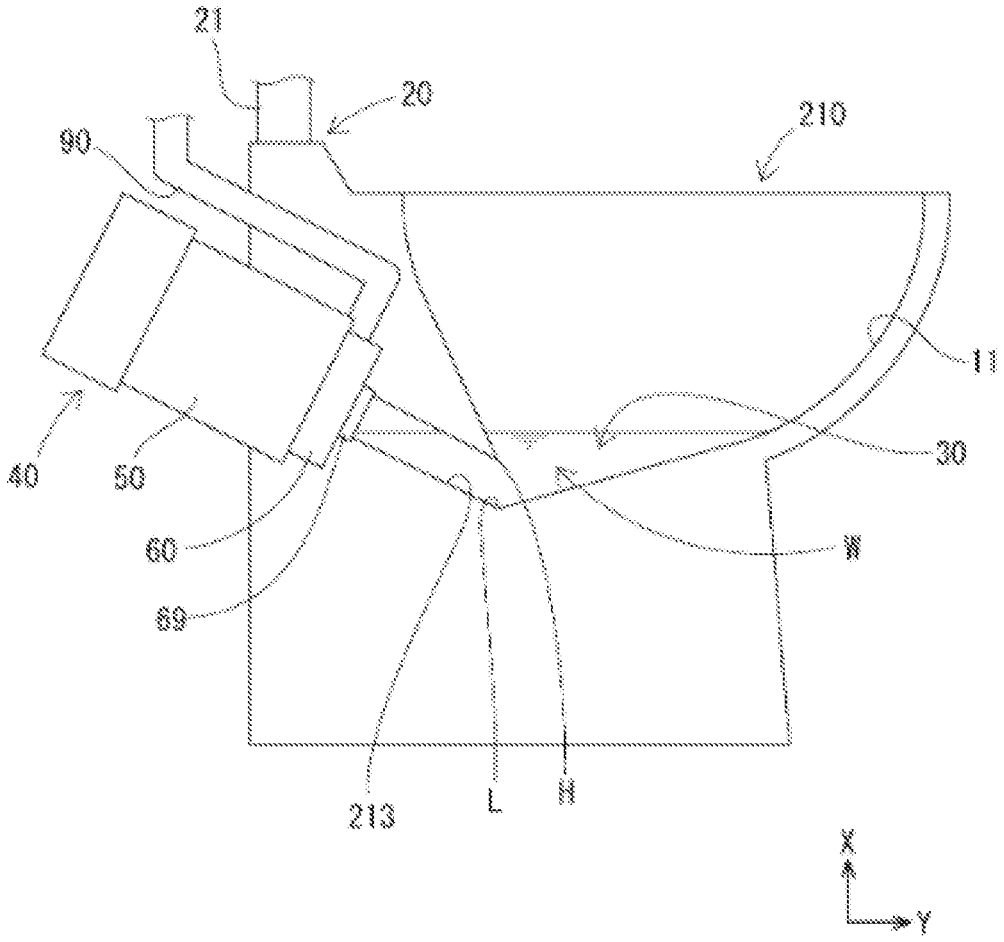

[FIG. 18]
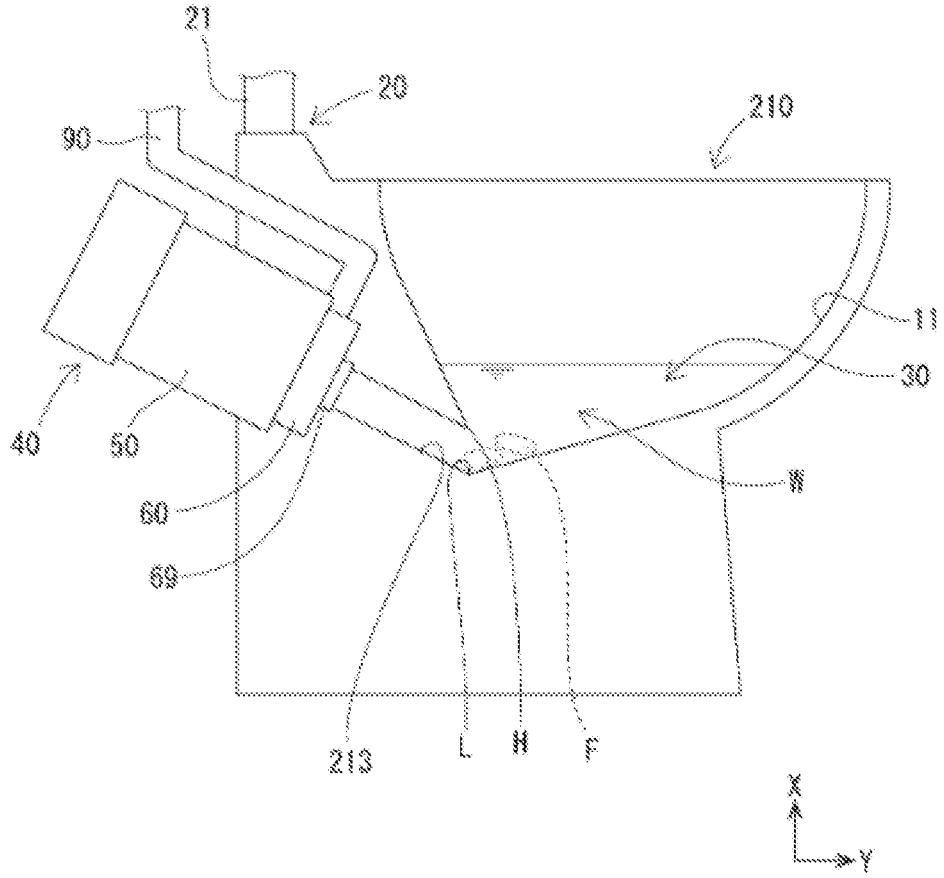

[FIG. 19]
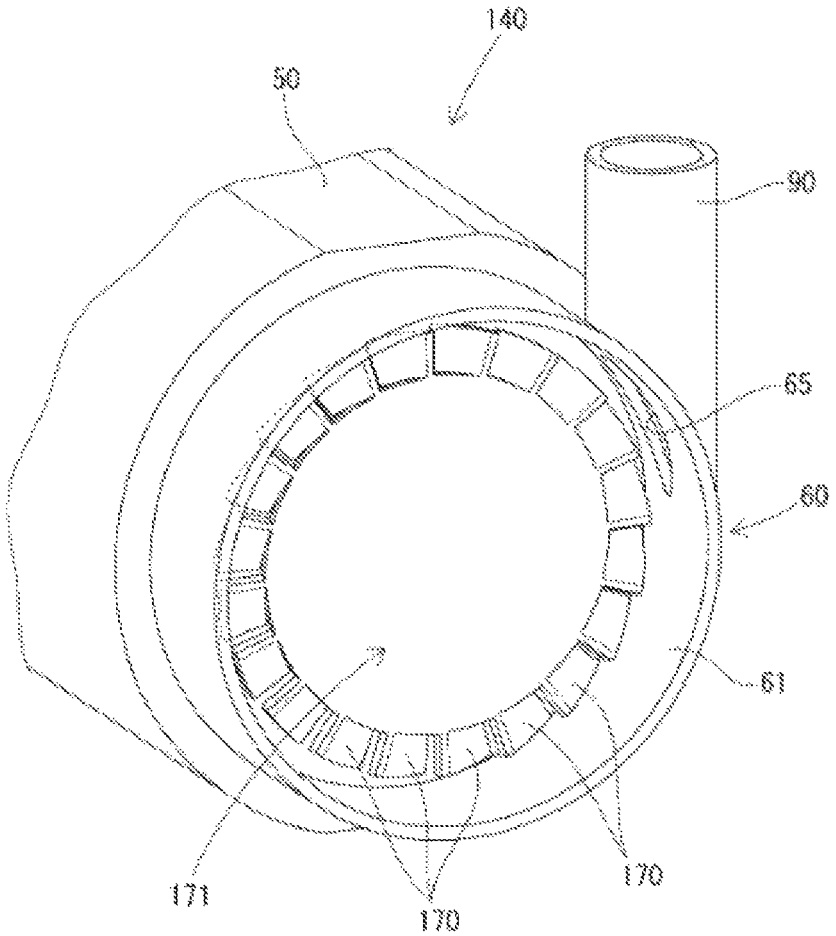

[FIG. 20]
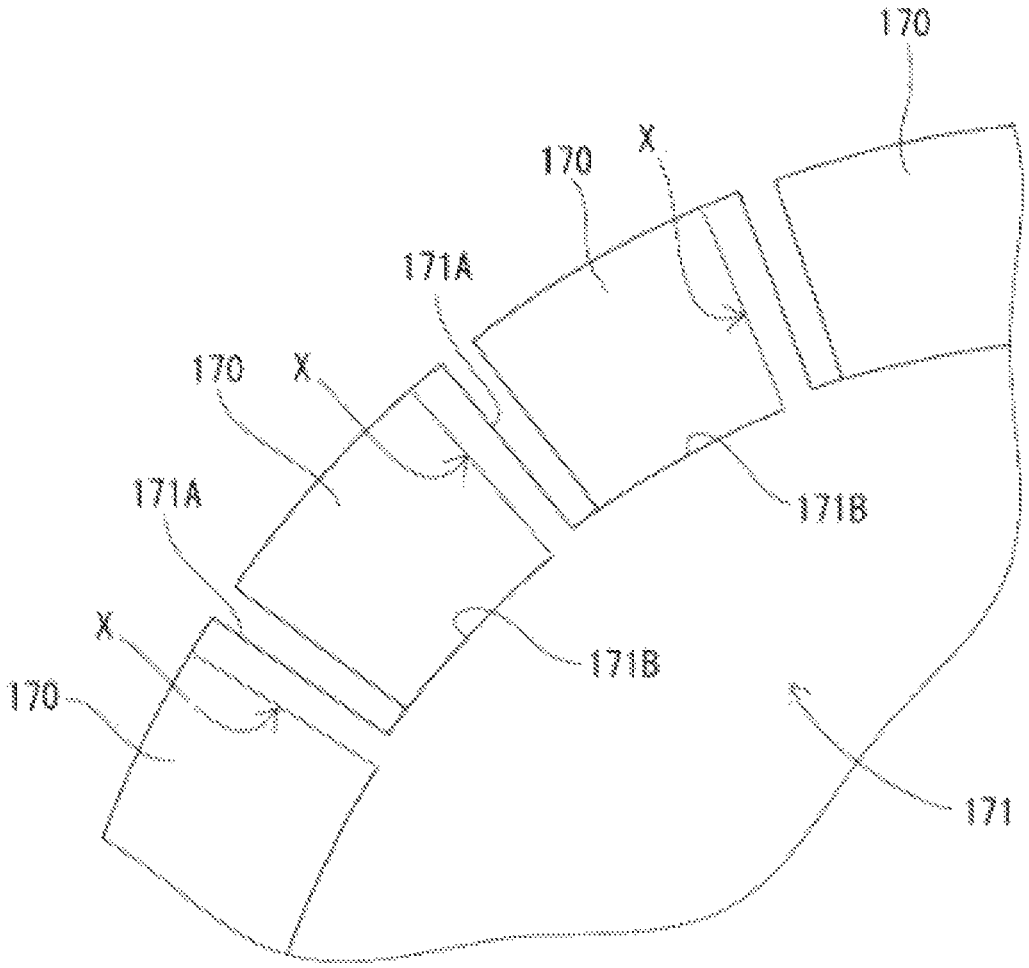

TOILET APPARATUS

TECHNICAL FIELD

The present disclosure relates to a toilet apparatus.

BACKGROUND ART

Japanese Unexamined Patent Application Publication No. 2009-102979 discloses a force-feed type toilet apparatus. In this toilet apparatus, a toilet is provided with a flap valve. Furthermore, a breaking-up part is provided behind the flap valve. Solid matter discharged from the toilet flows into the breaking-up part. The solid matter broken up by the breaking-up part is force-fed into a force-feed passage by a pump.

Japanese Unexamined Patent Application Publication No. 2009-102979 discloses a conventional toilet apparatus. This toilet apparatus includes a toilet bowl part, a storage part, and a pump. The storage part is connected to a discharge port formed in a lower portion of the toilet bowl part. The storage part stores waste matter fallen from the toilet bowl part and wash water. The pump is provided at a lower portion of the storage part. This toilet apparatus breaks up waste matter stored in the storage part and discharges waste water containing the broken up waste matter from the storage part via the pump.

SUMMARY OF INVENTION

This conventional toilet apparatus has a flap valve and the breaking-up part provided behind the toilet, which tends to increase the dimensions in the front-back direction.

In light of the conventional circumstances described above, an object of a first toilet apparatus is to provide a compact toilet apparatus.

In this conventional toilet apparatus, the storage part is disposed below the discharge port of the toilet bowl part, and the pump is further provided at a lower portion of the storage part, so space for disposing the storage part and the pump below the toilet bowl part is required, which runs the risk of increasing the overall height dimension. That is, this toilet apparatus runs the risk of high positioning where the height of the upper end of the toilet bowl part is higher than that of a typical toilet. Alternatively, when the upper end of the toilet bowl part is set to the same height as that of a typical toilet, this toilet apparatus runs the risk of the storage part needing to be disposed below an installation surface on which the toilet is installed.

In light of the conventional circumstances described above, an object of a second toilet apparatus is to provide a toilet apparatus that allows enlargement of a height dimension to be suppressed.

The first toilet apparatus includes: a toilet having a toilet bowl that is open on a lower end and a flapper valve for opening and closing the opening, a buffer tank provided below the flapper valve, and a breaking-up part for breaking-up waste matter stored in the buffer tank, having an inflow port on a side surface of the buffer tank below the upper end of the buffer tank that communicates with the toilet in a connected state.

The second toilet apparatus includes: a toilet bowl part, a storage part for storing waste matter and wash water spouted into the toilet bowl part, an ascending passage that extends to a downstream side of the storage part and is inclined up toward the downstream side, and a pump part provided on the downstream side of the ascending passage that is disposed at a position higher than a lowest end part of the storage part in the up-down direction.

BRIEF DESCRIPTION OF DRAWINGS

FIG. 1 is a perspective view illustrating a restroom wherein the toilet apparatus of embodiment 1 is installed, FIG. 2 is a partial side cross-sectional view illustrating the toilet apparatus of embodiment 1, FIG. 3 is a plan view illustrating the toilet apparatus of embodiment 1, FIG. 4 is a partial side cross-sectional view illustrating the buffer tank of the toilet apparatus of embodiment 1 with the periphery thereof enlarged, FIG. 5 is a perspective view illustrating the breaking-up part, a conveyance pump, and one part of a motor of embodiment 1, FIG. 6 is a partial side cross-sectional view illustrating the buffer tank in another embodiment with the breaking-up part enlarged, FIG. 7 is a perspective view illustrating a breaking-up wing in another embodiment, FIG. 8 is a perspective view illustrating a toilet apparatus in another embodiment, FIG. 9 is a schematic view illustrating the toilet in the toilet apparatus of embodiment 2 in a pre-washed state, FIG. 10 is a schematic view illustrating a state when starting a breaking-up pump in the toilet apparatus of embodiment 2, FIG. 11 is a perspective view illustrating the main parts of the breaking-up pump included in the toilet apparatus of embodiment 2, FIG. 12 is a cross-sectional view illustrating the main parts of the breaking-up pump included in the toilet apparatus of embodiment 2, FIG. 13 is a front view illustrating the breaking-up pump included in the toilet apparatus of embodiment 2, FIG. 14 is a front view illustrating a breaking-up blade of embodiment 2, FIG. 15 is a schematic view illustrating the toilet in the toilet apparatus of embodiment 3 in a pre-washed state, FIG. 16 is a schematic view illustrating a state when starting the breaking-up pump in the toilet apparatus of embodiment 3, FIG. 17 is a schematic view illustrating the toilet in the toilet apparatus of embodiment 4 in a pre-washed state, FIG. 18 is a schematic view illustrating a state when starting the breaking-up pump in the toilet apparatus of embodiment 4, FIG. 19 is a perspective view illustrating the main parts of the breaking-up pump, which includes discharge fins equipped with a breaking-up function, and FIG. 20 is an enlarged view of a portion of the discharge fins in FIG. 19.

EMBODIMENTS OF THE INVENTION

Embodiment 1

Embodiment 1, which embodies a first toilet apparatus 100, is described with reference to the drawings. In the following description, for an up-down direction, the positive direction of the Z-axis illustrated in FIG. 1 is assumed to be the up direction and the negative direction of the Z-axis is assumed to be the down direction. For the left-right direction, the positive direction of the Y-axis illustrated in FIG. 1 is assumed to be the left direction, and the negative direction of the Y-axis is assumed to be the right direction. For the front-back direction, the positive direction of the X-axis illustrated in FIG. 1 is assumed to be the front direction, and the negative direction of the X-axis is assumed to be the back direction. Specifically, the front-back direction, the left-right direction, and the up-down direction respectively indicate the front-back direction, left-right direction, and up-down direction as seen from the perspective of an individual seated on a toilet seat, which is not illustrated.

The toilet apparatus 100 is installed, for example, within a restroom R as illustrated in FIG. 1. The restroom R is provided in a residency, vehicle, or the like. As illustrated in FIG. 2, the toilet apparatus 100 includes a toilet 10, a buffer tank 18, a breaking-up part 12, a conveyance pump 13, a drainage tank 14, a water supply tank 15, a water supply pump 16, and a control part 72. The toilet 10 has a toilet bowl 10A, a water-conducting part 10B, and a connecting member 31. The toilet bowl 10A is bowl-like in form and open in an upper direction. The toilet bowl 10A has a discharge port 10M, which is an opening passing through in the up-down direction, formed on a lower end thereof. The discharge port 10M is substantially circular in a plan view as seen from above (see FIG. 3).

The water-conducting part 10B is an upper end part of a back part of the toilet 10 and is provided behind the toilet bowl 10A. A back part of the water-conducting part 10B communicates with one end part of a water-conducting passage 10E and is connected thereto. The other end part of the water-conducting passage 10E communicates with the water supply pump 16 described below and is connected thereto. A spout port 10F, which communicates with the toilet bowl 10A, is formed passing through the front end of the water-conducting part 10B. The toilet 10 has a toilet seat and a toilet lid, which are not illustrated, attached thereto.

The connecting member 31 communicates with the discharge port 10M of the toilet bowl 10A and is connected thereto. The connecting member 31 is substantially cylindrical in form, and has an upper end opening connected so as to cover the outer peripheral surface of the discharge port 10M. As illustrated in FIG. 4, the connecting member 31 has a gasket 30A, a flapper valve 30B, and a support member 30C. The gasket 30A is, for example, made of rubber and is cylindrical in form. One open end of the gasket 30A is connected so as to communicate with the discharge port 10M of the toilet bowl 10A.

The flapper valve 30B is substantially flat and dish-like in form over an entire periphery thereof. The support member 30C is formed substantially L-shaped. A rotating shaft part 30E is provided at the position where a long side and a short side of the support member 30C connect, and the support member 30C is rotatably supported around the rotating shaft part 30E. A tip end portion of the long side extending laterally couples with the flapper valve 30B to support the flapper valve 30B. A hanging, extending lower end portion of the short side is locked by one end of a tension coil spring 30G. The other end of the tension coil spring 30G is coupled to an outer surface portion of the connecting member 31. The lower end portion of the short side of the support member 30C is pulled by the tension coil spring 30G in a direction in which the long side is lifted upward. In this manner, the flapper valve 30B blocks an open lower end of the gasket 30A via a pulling force of the tension coil spring 30G, whereby a closed state of the discharge port 10M is maintained. The flapper valve 30B and the gasket 30A close the discharge port 10M, which keeps odor below the flapper valve 30B from flowing to the restroom R side. A spring constant of the tension coil spring 30G and a length dimension of the long side and a length dimension of the short side of the support member 30C are set such that when a predetermined amount of wash water is stored in the toilet bowl 10A, the flapper valve 30B descends and allows the discharge port 10M to open.

In the support member 30C, the hanging, extending lower end portion of the short side is coupled by one end portion of an operation shaft 30D. The operation shaft 30D is of a rod-like form that is long in one direction. For example, as illustrated in FIG. 2, the other end portion of the operation shaft 30D couples with the lower end portion of a pulling-up shaft 30H through a coupling member 30F provided below the water-conducting part 10B. The pulling-up shaft 30H is of a rod-like form that is long in one direction. An upper end portion of the pulling-up shaft 30H is coupled to an operating part 10C provided above the toilet 10. The operating part 10C is, for example, a so-called lever that a user holds and rotates to operate.

When the operating part 10C is operated, the pulling-up shaft 30H is pulled upward, and through the coupling member 30F, the operation shaft 30D moves backward. This pulls the hanging lower end portion of the short side of the support member 30C backward, rotates the support member 30C and the flapper valve 30B around the rotating shaft part 30E, and moves the end portion of the long side of the support member 30C and the flapper valve 30B downward (see FIG. 4). In this manner, the flapper valve 30B separates from the gasket 30A, and the discharge port 10M is opened.

When operation of the operating part 10C is stopped, the pulling-up shaft 30H descends and the operation shaft 30D moves forward. Along with this, the pulling force of the tension coil spring 30G rotates the support member 30C and the flapper valve 30B around the rotating shaft part 30E and moves the end portion of the long side of the support member 30C and the flapper valve 30B upward. In this manner, the flapper valve 30B blocks the open lower end of the gasket 30A, whereby a closed state of the discharge port 10M is maintained (see FIG. 4). In this manner, the flapper valve 30B opens and closes the discharge port 10M.

The operating part 10C is provided with an operation detection part 10D. For example, an operation detection part 10D uses a well-known microswitch or the like. The operation detection part 10D is electrically connected to the control part 72, which is described below. The operation detection part 10D is configured to output an operation detection signal D toward the control part 72 when operation (that is, rotation) of the operating part 10C is detected, and to not output the operation detection signal D when the operating part 10C is not operated (that is, not rotated).

As illustrated in FIG. 4, the buffer tank 18 is cylindrical in form, wherein an upper end 111A is open and a lower end 11B is closed. The toilet 10 is installed on an installation surface Y. The buffer tank 18 is disposed so as to pass through the installation surface Y in the up-down direction. Specifically, an upper portion of the buffer tank 18 protrudes above the installation surface Y, and a lower portion is disposed below the installation surface Y. The front side of the buffer tank 18 is formed as a curved surface that orients backward moving from the upper portion to the lower portion. The open upper end 11A of the buffer tank 18 communicates with a lower end opening of the connecting member 31 and is connected thereto. That is, the upper end 11A of the buffer tank 18 connects with the discharge port 10M through the connecting member 31. The buffer tank 18 is provided below the flapper valve 30B. The lower end of the buffer tank 18 attached to the toilet 10 inclines slightly downward going backward. The back side of the lower end portion of the buffer tank 18 opens going backward. The lower end of the buffer tank 18 may be inclined downward while attached to the toilet 10, and having the lower end of the buffer tank 18 be inclined downward prior to attachment to the toilet 10 is not required.

The breaking-up part 12 has a breaking-up cylinder 12E that is open on both ends, a rotating shaft 12A that extends in the front-back direction, and a breaking-up wing 12B that is coupled to the rotating shaft 12A. One open end of the breaking-up cylinder 12E communicates with the opening formed on the back side of the lower end portion of the buffer tank 18 and is connected thereto. One end of the breaking-up cylinder 12E is an inflow port 12C of the breaking-up part 12. Among side surfaces below the upper end 11A of the buffer tank 18, the inflow port 12C communicates with a side surface on the back side. That is, the breaking-up part 12 communicates with the back side of the buffer tank 18 that is below the upper end 11A of the buffer tank 18 and is connected thereto. Side surface as referred to here also includes a side surface on the right side, a side surface on the left side, and a side surface on the front side of the buffer tank 18. The rotating shaft 12A is coaxially disposed in the breaking-up cylinder 12E.

A breaking-up wing 12B has a plate part 12F that widens orthogonal to the rotating shaft 12A, and two breaking-up blades 12D formed by cutting and bending both end portions of the plate part 12F interposing the rotating shaft 12A to face inside the buffer tank 18 (see FIG. 5). A tip end portion of the breaking-up blades 12D (end edge on the buffer tank 18 side) protrudes further inside the buffer tank 18 than the one end of the breaking-up cylinder 12E. That is, the tip end portion of the breaking-up blades 12D (end edge on the buffer tank 18 side) of the breaking-up wing 12B is disposed inside the buffer tank 18. The tip end of the breaking-up blades 12D is positioned behind the discharge port 10M.

The conveyance pump 13 has a conveyance cylinder 13E that is open on both ends, a rotating shaft 13A that extends in the front-back direction, and an impeller 13B that is coupled to the rotating shaft 13A. One open end of the conveyance cylinder 13E communicates with a separate open end of the breaking-up cylinder 12E. The rotating shaft 13A is coaxially disposed in the conveyance cylinder 13E. A tip end of the rotating shaft 13A of the conveyance pump 13 and a back end of the rotating shaft 12A of the breaking-up part 12 are coaxially coupled. The rotating shaft 13A of the conveyance pump 13 and the rotating shaft 12A of the breaking-up part 12 are coaxial. A conveyance port 13C is formed as an opening in the conveyance cylinder 13E. A conveyance passage 14A communicates with the conveyance port 13C and is connected thereto. The impeller 13B has a circular plate 13F orthogonal to the rotating shaft 13A and a plurality of impeller blades 13G that widen radially from the rotating shaft 13A (see FIG. 5).

A motor M is disposed behind the conveyance pump 13. The tip end of a drive shaft S of the motor M is coupled to the back end of the rotating shaft 13A. The motor M is electrically connected to the control part 72 (see FIG. 2). The motor M is controlled by operation thereof by the control part 72. Rotational force generated by the motor M is transmitted to the rotating shaft 13A and the rotating shaft 12A through the drive shaft S. This integrally rotates the rotating shaft 13A, the impeller 13B, the rotating shaft 12A, and the breaking-up wing 12B. The breaking-up part 12, the conveyance pump 13, and the motor M are disposed below the installation surface Y.

When the impeller 13B rotates, sewage Sew stored in the buffer tank 18 (also called simply sewage Sew hereinafter) is sucked into the inflow port 12C, and solid matter contained in the sewage Sew approaches and is broken up by the breaking-up blades 12D of the breaking-up part 12. The sewage Sew contains wash water, urine, feces, toilet paper, and the like. Among these, feces, toilet paper, and the like are the solid matter contained in the sewage Sew, and wash water and urine are fluids contained in the sewage Sew. Broken up solid matter and fluid contained in the sewage Sew are conveyed in the conveyance passage 14A via the breaking-up part 12 and the conveyance port 13C of the conveyance pump 13 Since the inflow of unbroken-up solid matter does not need to be taken into consideration, the inner diameter of the conveyance passage 14A can be reduced. In this manner, the conveyance pump 13 flows solid matter broken up in the breaking-up part 12 toward the conveyance port 13C, conveying such to the conveyance passage 14A downstream. The rotating shaft 12A, the rotating shaft 13A, and the drive shaft S of the motor M are in a state in which the breaking-up part 12 is attached to the buffer tank 18, which is attached to the toilet 10, and these are inclined slightly downward going backward.

As illustrated in FIG. 3, in a plan view as seen from above, the buffer tank 18, the breaking-up part 12, the conveyance pump 13, and the motor M are disposed at positions inside of an outer edge of the toilet 10. Specifically, at least one part among an entirety of the buffer tank 18, an entirety of the breaking-up part 12, an entirety of the conveyance pump 13, and the motor M is disposed at a position inside of the outer edge of the toilet bowl 10A in a plan view as seen from above. Because the buffer tank 18 and the toilet bowl 10A have this sort of positional relationship, sewage in the toilet bowl 10A can immediately flow toward the buffer tank 18.

For example, when the operating part 10C is operated once and one round's worth of wash water for washing the toilet bowl 10A has flowed into the buffer tank 18, the breaking-up part 12, and the conveyance pump 13, the inflow portion 12C of the breaking-up part 12 is submerged (see FIG. 4). At this time, the inflow port 12C of the breaking-up part 12 is positioned below a water surface Ws1 of the wash water that flowed into the buffer tank 18 (see FIG. 4). In other words, the inflow port 12C communicates with the buffer tank 18 at a position that is submerged in the state wherein one round's worth of wash water for washing the toilet bowl 10A is stored in the buffer tank 18. The sewage Sew, being wash water to which waste matter (urine, feces, toilet paper, and the like) is added, is of an amount greater than that of one round's worth of wash water for washing the toilet bowl 10A. Therefore, when this sewage Sew flows into the buffer tank 18, a water surface Ws2 forms at a position higher than the water surface Ws1 where one round's worth of wash water for washing the toilet bowl 10A had flowed into the buffer tank 18, and the inflow port 12C of the breaking-up part 12 is submerged more deeply. That is, the inflow port 12C of the breaking-up part 12 is positioned below the water surface Ws2 of the sewage Sew that had flowed into the buffer tank 18 (see FIG. 4).

The drainage tank 14 communicates with and is connected to the conveyance port 13C of the conveyance pump 13 through the conveyance passage 14A. As illustrated in FIGS. 1 and 3, the drainage tank 14 is behind the toilet 10 in the restroom R and is disposed behind a partition wall Pw rising up behind the toilet 10. An upper end of the partition wall Pw has a shelf board B, for example, disposed thereon (see FIG. 1). The drainage tank 14 is disposed within a range of a frontage dimension Fd of the restroom R in which the toilet 10 is disposed as seen from in front of the toilet 10 (see FIG. 3). An upper end T of the drainage tank 14 is disposed at a position higher than a position P of the flapper valve 30B (see FIG. 2).

The water supply tank 15 stores wash water for washing the toilet bowl 10A. The water supply tank 15 is behind the toilet 10 in the restroom R and is disposed behind the partition wall Pw. The water supply tank 15 is disposed within the range of the frontage dimension Fd of the restroom R in which the toilet 10 is disposed as seen from forward of the toilet 10 (see FIG. 3). That is, both the drainage tank 14 and the water supply tank 15 are disposed within the range of the frontage dimension Fd of the restroom R in which the toilet 10 is disposed as seen from in front of the toilet 10 (see FIG. 3).

The water supply pump 16 is provided above the water supply tank 15. The water supply pump 16 is behind the toilet 10 in the restroom R and is disposed behind the partition wall Pw rising up behind the toilet 10. The water supply pump 16 draws up the wash water stored in the water supply tank 15 and supplies the wash water to the toilet bowl 10A through the water-conducting passage 10E, the water-conducting part 10B, and spout port 10F.

The control part 72 is configured, for example, having a microcomputer as a primary body, and is configured having a computing apparatus such as a CPU (central processing unit), memory such ROM (read only memory) or RAM (random access memory), an A/D converter, and the like. For example, the control part 72 has a function that allows operation of the motor M to be stopped after the motor M is rotationally driven for a predetermined amount of time when the operation detection signal D from the operation detection part 10D is input once (see FIG. 2). The control part 72 has a function of operating the water supply pump 16 to supply the toilet bowl 10A with a predetermined amount of wash water from the water supply tank 15 when the operation detection signal D from the operation detection part 10D is input once (see FIG. 2). The predetermined amount is, for example, one liter. This predetermined amount (one liter) flushes waste matter from the toilet bowl 10A, and is a minimum amount of wash water for one round's worth considered necessary for breaking up in the breaking-up part 12.

One example of operation of the toilet apparatus 100 will be described.

A user operates the operating part 10C once. Specifically, the user holds the operating part 10C, twists so that the operating part 10C rotates a predetermined angle, then releases their hand from the operating part 10C. Then, the operating part 10C returns to an original orientation. By doing so, the operation detection part 10D outputs the operation detection signal D once to the control part 72. Based on the operation detection signal D, the control part 72 has the water supply pump 16 draw up the predetermined amount of wash water (one liter) from the water supply tank 15 and supply the toilet bowl 10A with the wash water.

When the user holds the operating part 10C and twists so that the operating part 10C rotates the predetermined angle, the short side of the support member 30C is pulled backward via the pulling-up shaft 30H, the coupling member 30F, and the operation shaft 30D. This rotates the support member 30C and the flapper valve 30B around the rotating shaft part 30E and moves the end portion of the long side of the support member 30C and the flapper valve 30B downward, opening the discharge port 10M. That is, at the same time that wash water is supplied to the toilet bowl 10A, the flapper valve 30B descends at an arbitrary timing, and the discharge port 10M is opened (see FIG. 4).

Then, along with the predetermined amount of wash water, waste matter within the toilet bowl 10A passes through the discharge port 10M and falls directly into the buffer tank 18. When the predetermined amount of wash water and waste matter fall into the buffer tank 18, the flapper valve 30B immediately ascends, blocking the lower end of the gasket 30A, and closing the discharge port 10M. In this manner, the flapper valve 30B opens and closes the discharge port 10M.

Based on input of the operation detection signal D, the control part 72 has the motor M initiate rotational drive. When rotational drive of the motor M is initiated, the drive shaft S of the motor M as well as the rotating shaft 13A, the rotating shaft 12A, the impeller 13B, and the breaking-up blades 12D also undergo the initiation of rotation.

When the sewage Sew (predetermined amount of wash water, and waste matter) flow into the buffer tank 18, the inflow port 12C of the breaking-up part 12 that communicates with the buffer tank 18 is submerged in the sewage Sew (see FIG. 4). Specifically, an upper end of the inflow port 12C of the breaking-up part 12 takes on a state of being positioned under the water surface Ws2 of the sewage Sew inside the buffer tank 18. Along with this, the conveyance pump 13 and the motor M also take on a state of being positioned under the water surface Ws2 of the sewage Sew inside the buffer tank 18.

The sewage Sew that had flowed into the buffer tank 18 is sucked into the inflow port 12C of the breaking-up part 12 by rotation of the impeller 13B, and flows toward the conveyance port 13C. At this time, the solid matter (waste matter) contained in the sewage Sew is broken up by contact with the rotating breaking-up blades 12D, and along with fluid (wash water and urine) contained in the sewage Sew, is conveyed to the drainage tank 14 via the breaking-up part 12, the conveyance pump 13, the conveyance port 13C, and the conveyance passage 14A.

After the sewage Sew inside the buffer tank 18 is conveyed to the drainage tank 14, the control part 72 stops the rotational drive of the motor M. That is, the control part 72 causes the motor M to stop the rotation after being rotationally driven for the predetermined amount of time.

According to the embodiment configured as described above, the following effects are exhibited.

The toilet apparatus 100 includes the toilet 10, the buffer tank 18, and the breaking-up part 12. The toilet 10 has the toilet bowl 10A whose lower end has an opening, the discharge port 10M, formed therein, and the flapper valve 30B for opening and closing the discharge port 10M. The buffer tank 18 is provided below the flapper valve 30B. The inflow port 12C of the breaking-up part 12 communicates with the side surface on the back side of the buffer tank 18 below the upper end 111A of the buffer tank 18 in a state connected to the toilet 10, and breaks up the solid matter contained in the sewage Sew stored in the buffer tank 18.

According to this configuration, the buffer tank 18 is provided below the flapper valve 30B, and the inflow port 12C of the breaking-up part 12 communicates with the side surface at the back side of the buffer tank 18, which facilitate a mutually proximal disposition of the toilet 10, the buffer tank 18, and the breaking-up part 12. Therefore, it is easy to make a compact configuration of the toilet apparatus 100.

The buffer tank 18 of the toilet apparatus 100 stores waste matter inside the toilet bowl 10A that passes through the discharge port 10M and falls directly into the buffer tank 18. According to this configuration, solid matter contained in the sewage Sew passes through the discharge port 10M of the toilet bowl 10A and falls directly into the buffer tank 18, so the retention of solid matter midway can be suppressed. Therefore, because there is no need for the wash water to convey solid matter retained midway, a small amount of the wash water is able to convey the solid matter contained in the sewage Sew inside the buffer tank 18.

The upper end 11A of the buffer tank 18 of the toilet apparatus 100 is connected to the discharge port 10M through the connecting member 31, and the breaking-up part 12 communicates with the buffer tank 18 below the upper end 11A of the buffer tank 18. According to this configuration, the breaking-up part 12 connects to the buffer tank 18 below the upper end 11A of the buffer tank 18, and the solid matter contained in the sewage Sew stored in the buffer tank 18 easily flows from the inflow port 12C into the breaking-up part 12.

The breaking-up part 12 of the toilet apparatus 100 is connected to the back side of the buffer tank 18. According to this configuration, the breaking-up part 12 can be brought proximal to a flow passage such as the conveyance passage 14A, which is often provided behind the toilet 10, so waste matter broken up in the breaking-up part 12 is easily discharged toward the flow passage.

The toilet apparatus 100 includes the conveyance pump 13 for conveying solid matter broken up in the breaking-up part 12 to a side further downstream and which communicates with the side further downstream than the breaking-up part 12. According to this configuration, the broken up solid matter can be conveyed to a desired location regardless of the height of the desired location.

The rotating shaft 12A of the breaking-up part 12 of the toilet apparatus 100 and the rotating shaft 13A of the conveyance pump 13 are coaxial. According to this configuration, the toilet apparatus 100 can be made compact and is capable of driving the breaking-up part 12 and the conveyance pump 13 using one of the motor M.

The toilet apparatus 100 includes the drainage tank 14 that communicates with the downstream side of the conveyance pump 13, and the upper end of the drainage tank 14 is at a position higher than that of the flapper valve 30B. According to this configuration, the position of the toilet apparatus 100 can easily be positioned low regardless of the size of the drainage tank 14. For example, if this toilet apparatus 100 is provided in a vehicle, the drainage tank 14 need not be provided under the floor of the vehicle, and a floor surface of the vehicle can easily be lowered.

The toilet apparatus 100 includes the water supply tank 15 for storing wash water for washing the toilet bowl 10A, the water supply tank 15 and the drainage tank 14 are behind the toilet 10, and these are disposed within the range of the frontage dimension Fd of the restroom R in which the toilet 10 is disposed as seen from in front of the toilet 10. According to this configuration, the water supply tank 15 and the drainage tank 14 can be made less readily visible to users, allowing the toilet apparatus 100 to be further compacted.

The toilet apparatus 100 has the buffer tank 18 and the breaking-up part 12 positioned inside the outer edge of the toilet 10 in a plan view as seen from above. According to this configuration, the buffer tank 18 and the breaking-up part 12 can be disposed directly below the toilet 10, which allows the flow passage joining the buffer tank 18 and the breaking-up part 12 to be shortened. Therefore, the occurrence of situations where solid matter contained in the sewage Sew stored in the buffer tank 18 inside this flow passage is retained and is not broken up by the breaking-up part 12 is suppressed, and breaking-up of this solid matter can be favorably performed. Along with this, the discharge of sewage from the toilet bowl 10A to the buffer tank 18 can be more smoothly performed.

The inflow port 12C of the toilet apparatus 100 communicates with the buffer tank 18 at a position that is submerged in the state wherein one round's worth of wash water for washing the toilet bowl 10A is stored in the buffer tank 18. According to this configuration, the inflow port 12C of the breaking-up part 12 is submerged every time the toilet bowl 10A undergoes one wash, so whenever a user uses the toilet apparatus 100, the breaking-up part 12 is able to favorably break up the solid matter contained in the sewage Sew without idling.

The breaking-up part 12 of the toilet apparatus 100 has the rotating breaking-up wing 12B, and the end edge on the buffer tank 18 side of the breaking-up wing 12B is disposed inside the buffer tank 18. According to this configuration, the solid matter contained in the sewage Sew inside the buffer tank 18 can easily be brought into contact with the breaking-up wing 12B, and the solid matter can be favorably broken up. Furthermore, the breaking-up wing 12B is disposed inside the buffer tank 18 without passing through the flow passage between the buffer tank 18 and the breaking-up part 12, so situations where solid matter is retained inside the flow passage and the flow passage is clogged can be avoided.

Embodiments 2 and 3

Embodiments 2 and 3, which embody second toilet apparatuses 1 and 2, are described with reference to the drawings. In the following description, the up-down direction is the up-down direction in a state wherein the toilet 10 is installed on a horizontal installation surface. For the front-back direction, in the state wherein the toilet 10 is installed on a horizontal installation surface, a direction in which a water supply pipe 21 is connected to a toilet bowl part 11 is backward, and the opposite direction is frontward. The left-right direction is the left-right direction when viewed rearward of the toilet 10 from in front of the toilet 10 in the state wherein the toilet 10 is installed on a horizontal installation surface. In each drawing, the up direction is the positive direction of the X-axis, the down direction is the negative direction of the X-axis, the front direction is the positive direction of the Y-axis, and the back direction is the negative direction of the Y-axis.

Embodiment 2

As illustrated in FIG. 9 and FIG. 10, the toilet apparatus 1 of embodiment 2 includes the toilet 10 and a breaking-up pump 40. The toilet 10 has the toilet bowl part 11, an ascending passage 17, and a water supply part 20. The toilet bowl part 11 is of a bowl shape, open upward. The toilet bowl part 11 has a discharge port 11C that is formed opening rearward toward a back side lower end portion. The toilet bowl part 11 has a spout port, which is not illustrated, formed at a back side upper portion. The spout port spouts wash water W supplied by the water supply part 20.

The ascending passage 17 is cylindrical. The upstream end of the ascending passage 17 is connected to the discharge port 11C formed at the back side lower end portion of the toilet bowl part 11. The ascending passage 17 communicates with a toilet bowl part 11. The ascending passage 17 extends diagonally upward facing backward. That is, the ascending passage 17 inclines up toward the downstream side. A downstream end portion 13D of the ascending passage 17 extends in a horizontal direction facing backward.

The toilet 10 has a storage part 30 configured of a lower portion of the toilet bowl part 11 and the ascending passage 17. The ascending passage 17 extends to the downstream side of the storage part 30. As illustrated in FIG. 9, the storage part 30 stores the wash water W before a toilet wash is executed. In the toilet 10, a water seal is formed by the wash water W stored in the storage part 30 in the standby state prior to executing the toilet wash. A water surface of the water seal (sealing water surface) formed by the wash water W stored in the storage part 30 is positioned higher than an upper end H of the upstream end of the ascending passage 17. The upper end H of the upstream end of the ascending passage 17 is a lowest position of the sealing water surface. In a state after the toilet wash is executed and before the breaking-up pump 40 described below is started, as illustrated in FIG. 10, the storage part 30 temporarily stores waste matter F (excrement, toilet paper, and the like), wash water W, and the like.

As illustrated in FIG. 9 and FIG. 10, the water supply part 20 has the water supply pipe 21. The upstream end portion of the water supply pipe 21 is connected to a water supply source such as a wash tank, which is not illustrated. The downstream end portion of the water supply pipe 21 is connected to the toilet 10. When the toilet wash is executed, the water supply part 20 supplies a predetermined amount of the wash water W to the toilet 10. The wash water W supplied by the water supply part 20 is spouted from the spout port of the toilet bowl part 11 and flows into the storage part 30 while swirling along the toilet bowl part 11.

As illustrated in FIG. 11 to FIG. 13, the breaking-up pump 40 has a rotary drive part 50, a housing 60, four discharge fins 70, and a breaking-up blade 80. The rotary drive part 50 rotationally drives the rotating shaft part 51 via an electric motor. The rotating shaft part 51 protrudes from the center portion of the front surface of the rotary drive part 50, extending in the front-back direction. The rotating shaft part 51 is cylindrical.

The housing 60 is provided further forward than the front surface of the rotary drive part 50. The housing 60 has a side wall portion 61 and a front wall portion 63. A side wall portion 61 of the housing 60 is cylindrical. The back end edge of the side wall portion 61 of the housing 60 is continuous with the front surface of the rotary drive part 50. The central axis of the side wall portion 61 of the housing 60 and the central axis of the rotating shaft part 51 extend on the same straight line. The side wall portion 61 of the housing 60 has an outflow port 65 formed therein. The outflow port 65 is connected to the upstream end of a discharge tube 90. The discharge tube 90 extends in the vicinity of the downstream side of the outflow port 65 in a tangential direction of the side wall portion 61 of the housing 60. The discharge tube 90 passes inside the housing 60.

As illustrated in FIG. 12, the front wall portion 63 of the housing 60 is attached to the front end portion of the side wall portion 61. The front wall portion 63 has a gasket P interposed between itself and the side wall portion 61, and is attached to the side wall portion 61 in a watertight manner. The front wall portion 63 of the housing 60 has an opening, an inflow port 67, formed in a center portion thereof. The front wall portion 63 of the housing 60 has a cylindrical connecting part 69 that continues along an inflow port 67 and extends in the front direction. As illustrated in FIG. 9 and FIG. 10, the connecting part 69 is connected to the downstream end portion 13D of the ascending passage 17 that extends in the horizontal direction facing backward. The housing 60 communicates with the ascending passage 17. A connection portion between the connecting part 69 of the housing 60 of the breaking-up pump 40 and the downstream end portion 13D of the ascending passage 17 is higher in the up-down direction than the upper end H of the upstream end of the ascending passage 17. The breaking-up pump 40 is provided on the downstream side of the ascending passage 17, and is disposed at a position higher than a lowest end portion L of the storage part 30 in the up-down direction.

As illustrated in FIG. 11 to FIG. 13, each of the discharge fins 70 is provided on the front surface of a circular plate 71 that rotates along with a rotating shaft part 51 of the rotary drive part 50. The circular plate 71 has the rotating shaft part 51 of the rotary drive part 50 penetrate the center thereof, and is thereby fixed to the rotating shaft part 51. The rotating shaft part 51 extends in a direction orthogonal to the front surface and the back surface of the circular plate 71. Each of the discharge fins 70 is a flat plate that rises forward from the front surface of the circular plate 71 and extends in a radial direction. As illustrated in FIG. 11, an edge part 70A of each of the discharge fins 70 close to the center of the circular plate 71 inclines forward in the direction of the outer periphery of the circular plate 71. A front end edge part 70B of each of the discharge fins 70 extends parallel to the front surface of the circular plate 71. An edge part 70C of each of the discharge fins 70 close to the outer peripheral edge of the circular plate 71 is orthogonal to the front surface of the circular plate 71 and the front end edge part 70B of the discharge fins 70. Aback end edge part 70D of each of the discharge fins 70 is continuous with the front surface of the circular plate 71. Each of the discharge fins 70 has a longer dimension in the radial direction of the circular plate 71 than a dimension in the front-back direction. Each of the discharge fins 70 and the circular plate 71 are housed inside the housing 60. As illustrated in FIG. 13, each of the discharge fins 70 is disposed at an equal interval in the peripheral direction of the circular plate 71. That is, in a front view as seen from in front of the rotating shaft part 51 of the rotary drive part 50 (referred to as "front view" hereinafter), an angle $\alpha$ at which a virtual line lying in the direction that the discharge fins 70 adjacent to the peripheral direction of the circular plate 71 respectively extend is 90 degrees.

The breaking-up blade 80 is formed by a process of cutting and bending a metal plate. As illustrated in FIG. 13 and FIG. 14, the outer form of the breaking-up blade 80 is substantially rectangular in the front view. The breaking-up blade 80 has a base plate part 81 and a pair of inclined pieces 85. The pair of inclined pieces 85 is provided respective to both end portions in the longitudinal direction of the breaking-up blade 80. The portions of the breaking-up blade 80 other than the inclined pieces 85 correspond to the base plate part 81.

As illustrated in FIG. 14, the base plate part 81 has a center part 82 and a pair of opposite end parts 83. The center part 82 of the base plate part 81 is rectangular in the front view as seen from in front of the base plate part 81. Each of the opposite end parts 83 is rectangular in the front view as seen from in front of the base plate part 81. Each of the opposite end parts 83 is respectively continuous with long sides 82L of the center part 82 that extend kitty-corner in the center part 82. First long sides 83LA, which are one of the long sides of each of the opposite end parts 83, extend on the line extending from short sides 82S of the center part 82. Second long sides 83LB, which are the other long sides of each of the opposite end parts 83, extend from substantially the center of the long sides 82L of the center part 82.

Each of the inclined pieces 85 is substantially rectangular. Each of the inclined pieces 85 is continuous with the second long sides 83LB of each of the opposite end parts 83 of the base plate part 81, and the second long sides 83LB are bent at a bend line and inclined forward. In the breaking-up blade 80, a through-hole 82A through which a tip end portion of the rotating shaft part 51 of the rotary drive part 50 penetrates is formed in the center of the center part 82 of the base plate part 81. The breaking-up blade 80 has a shape with order 2 rotational symmetry around the center point of the through-hole 82A in the front view as seen from in front of the base plate part 81. As illustrated in FIG. 11 to FIG. 13, the breaking-up blade 80 is fixed to the rotating shaft part 51, which penetrates the through-hole 82A of the center part 82 of the base plate part 81. The rotating shaft part 51 extends in a direction orthogonal to the front surface and the back surface of the base plate part 81. The breaking-up blade 80 rotates along with the rotating shaft part 51 of the rotary drive part 50.

As illustrated in FIG. 11 to FIG. 13, when the breaking-up pump 40 drives the rotary drive part 50 and rotates the rotating shaft part 51, each of the discharge fins 70 and the breaking-up blade 80 rotate. By having each of the discharge fins 70 rotate along with the rotating shaft part 51, the breaking-up pump 40 feeds sewage inside the housing 60 from the outflow port 65 to the discharge tube 90 through centrifugal force while agitating the solid matter such as the waste matter F that is broken up by the breaking-up blade 80 (feces and toilet paper), the wash water W, and the like. The breaking-up pump 40 sucks up the waste matter F, the wash water W, and the like inside the housing 60 by rotating each of the discharge fins 70 along with the rotating shaft part 51. That is, the breaking-up pump 40 has a pump part that functions as a centrifugal pump. The pump part of the breaking-up pump 40 is configured by the housing 60, the rotary drive part 50, and each of the discharge fins 70.

By having the breaking-up blade 80 rotate along with the rotating shaft part 51, the breaking-up pump 40 agitates the wash water W and the like while the breaking-up blade 80 breaks up the solid matter such as the waste matter F inside the housing 60 to form a highly fluid sewage. That is, the breaking-up pump 40 has a breaking-up part for breaking up solid matter such as the waste matter F. The breaking-up part of the breaking-up pump 40 is configured by the housing 60, the rotary drive part 50, and the breaking-up blade 80. Thus, the breaking-up pump 40 is provided with the pump part and the breaking-up part in an integral manner. The breaking-up blade 80 is provided further forward than each of the discharge fins 70. That is, the breaking-up blade 80 are disposed on a side further upstream than each of the discharge fins 70. From this, it can be said that this breaking-up pump 40 is provided with a breaking-up part on a side further upstream than the pump part.

As illustrated in FIG. 9, in the standby state prior to executing the toilet wash, this toilet apparatus 1 has the wash water W stored in the storage part 30 of the toilet 10. An amount of the wash water W stored in the storage part 30 of the toilet 10 in the standby state is approximately 1.5 L, as one example. The toilet 10 of this toilet apparatus 1 forms a water seal via the wash water W stored in the storage part 30.

When the toilet wash is executed, this toilet apparatus 1 supplies the predetermined amount of wash water W from the water supply part 20 to the toilet 10, and spouts the wash water W from the spout port of the toilet 10 into the toilet bowl part 11. In one round of the toilet wash, this toilet apparatus 1 spouts, as one example, approximately 1.5 L of the wash water W from the spout port of the toilet 10. As illustrated in FIG. 10, in this toilet apparatus 1, when the toilet wash is executed and the predetermined amount of wash water W is spouted into the toilet bowl part 11, a water level rises inside the storage part 30, the wash water W and the like flow inside the housing 60 of the breaking-up pump 40, and the inside of the housing 60 of the breaking-up pump 40 takes on a filled state. The filled state referred to here is not limited to the inside of the housing 60 being in a completely filled state, and may be a state wherein the pump part of the breaking-up pump 40 sucks up the waste matter F, the wash water W, and the like from the storage part 30 inside the housing 60, and the wash water W and the like flow inside the housing 60 to an extent that the sewage inside the housing 60 can be fed out from the outflow port 65 (likewise hereinafter).

When the inside of the housing 60 of the breaking-up pump 40 takes on a filled state, this toilet apparatus 1 starts the rotary drive part 50 of the breaking-up pump 40. Then, the breaking-up pump 40 sucks up the waste matter F, the wash water W, and the like which are retained in the storage part 30 through a suction force of the pump part, and these flow inside the housing 60. In the breaking-up part, the breaking-up pump 40 agitates the wash water W and the like while the breaking-up blade 80 breaks up the solid matter such as the waste matter F inside the housing 60 to form a highly fluid sewage. The breaking-up pump 40 feeds the sewage inside the housing 60 from the outflow port 65 to the discharge tube 90 through a force-feeding force of the pump part. When there is no more of the waste matter F, the wash water W, and the like from the storage part 30, the breaking-up pump 40 stops the rotary drive part 50. When the rotary drive part 50 is stopped, this toilet apparatus 1 supplies the predetermined amount of wash water W from the water supply part 20 to the toilet 10, the wash water W spouted from the spout port of the toilet 10 is stored in the storage part 30, and the toilet wash stops. This predetermined amount is 1.5 L, as one example. Thereby, this toilet apparatus 1 returns to the standby state prior to executing the toilet wash.

Embodiment 3

As illustrated in FIG. 15 and FIG. 16, the toilet apparatus 2 of embodiment 3 has a toilet 300 that differs from the toilet 10 of embodiment 2. Configurations similar to those of embodiment 2 are given the same reference numerals, and detailed descriptions thereof are omitted.

The toilet 300 includes a toilet main body 110, the water supply part 20, a coupling pipe 120, a flapper valve 130, and a storage part 150. The toilet main body 110 has a toilet bowl part 111 and a peripheral wall part 113. The toilet bowl part 111 is provided at the front side of the toilet main body 110. The toilet bowl part 111 is of a bowl shape, open upward. The toilet bowl part 111 has a discharge port 111A that is formed opening in a vertical direction at a lower end portion. The discharge port 1111A extends in cylindrical form in a vertical direction to the lower end portion of the toilet bowl part 111. The lower end portion of the discharge port 111A is attached by a cylindrical gasket 115. The central axis of the discharge port 111A and the central axis of a gasket 115 extend on the same straight line. The inner diameter of the discharge port 111A and the inner diameter of the gasket 115 are substantially the same. The toilet bowl part 111 has a spout port, which is not illustrated, formed at a back side upper portion. The spout port spouts wash water W supplied by the water supply part 20. The peripheral wall part 113 is formed spreading downward from an upper end edge of the toilet bowl part 111 so as to surround the toilet bowl part 111. The toilet main body 110 has an internal space K surrounded by the peripheral wall part 113 formed below the toilet bowl part 111.

The coupling pipe 120 is cylindrical. The coupling pipe 120 connects to a lower portion of the toilet bowl part 111 in a state in which the central axis thereof extends in the up-down direction. The central axis of the coupling pipe 120 extends as though in the same straight line as the central axis of the discharge port 1111A of the toilet bowl part 111. The inner diameter of the coupling pipe 120 is larger than the outer diameter of the gasket 115 attached to the discharge port 1111A of the toilet bowl part 111. An upper end edge portion of the coupling pipe 120 connects around the discharge port 111A of the toilet bowl part 111. The coupling pipe 120 is housed in the internal space K of the toilet main body 110.

The flapper valve 130 is attached inside the coupling pipe 120. The flapper valve 130 opens and closes the discharge port 111A formed on the lower portion of the toilet bowl part 111. The flapper valve 130 has a flapper valve main body 131, a support member 133, and a tension coil spring 135. The flapper valve main body 131 is disk-like. The outer diameter of the flapper valve main body 131 is larger than the outer diameter of the gasket 115 attached to the discharge port 111A of the toilet bowl part 111, and is smaller than the inner diameter of the coupling pipe 120. In a state wherein the flapper valve 130 closes the discharge port 111A of the toilet bowl part 111, the flapper valve main body 131 is positioned in a horizontal state, and the upper surface is in a state of contact with the lower end edge of the gasket 115 attached to the discharge port 111A of the toilet bowl part 111.

The support member 133 has a first support part 133A and a second support part 133B. The first support part 133A and the second support part 133B are rod-like. One end portion of the first support part 133A is coupled to a central portion of the lower surface of the flapper valve main body 131. The first support part 133A extends along the lower surface of the flapper valve main body 131. The other end portion of the first support part 133A extends in a outer direction beyond an outer edge of the flapper valve main body 131. One end portion of the second support part 133B connects with the other end portion of the first support part 133A. The second support part 133B, which has a direction orthogonal to the first support part 133A, extends downward from the one end portion to the other end portion in the state wherein the flapper valve 130 closes the discharge port 111A of the toilet bowl part 111. A length of the second support part 133B is shorter than a length of the first support part 133A. The support member 133 is rotatably supported. A rotation shaft of the support member 133 is the portion where the first support part 133A and the second support part 133B connect. The rotation shaft of the support member 133 is behind the discharge port 111A of the toilet bowl part 111, and extends horizontally in the left-right direction, slightly downward. The flapper valve main body 131 rotates and moves between the state wherein the upper surface is in contact with the lower end edge of the gasket 115 attached to the discharge port 111A of the toilet bowl part 111, closing the discharge port 111A, and a state wherein the upper surface separates from the discharge port 111A and opens the discharge port 111A by inclining downward, facing forward.

One end portion of the tension coil spring 135 is coupled to the other end portion of the second support part 133B, and the other end portion of the tension coil spring 135 is coupled to a side surface of the coupling pipe 120. The pulling force of the tension coil spring 135 acts in a closing direction of the flapper valve main body 131. When the waste matter F, the wash water W, and the like do not rest on an upper surface of the flapper valve main body 131, the flapper valve 130 closes the discharge port 111A of the toilet bowl part 111 via the pulling force of the tension coil spring 135. When the waste matter F, the wash water W, and the like do rest on the upper surface of the flapper valve main body 131, and a weight thereof is heavier than a predetermined weight, the flapper valve 130 opens the discharge port 111A of the toilet bowl part 111 by the flapper valve main body 131 rotating downward, and the waste matter F, the wash water W, and the like fall downward from the flapper valve main body 131. When the waste matter F, the wash water W, and the like fall from above the flapper valve main body 131, the flapper valve 130 closes the discharge port 111A of the toilet bowl part 111 by the flapper valve main body 131 rotating upward via the pulling force of the tension coil spring 135.

The storage part 150 has an inflow portion 151 and an ascending passage 153. The upper end portion of the inflow portion 151 forms an insertion port 151A that opens upward. The insertion port 151A is cylindrical. The inner diameter of the insertion port 151A is formed larger than the outer diameter of the coupling pipe 120. The insertion port 151A has a cylindrical gasket 157 attached thereto. The gasket 157 is in contact with the inner peripheral surface of the insertion port 151A. The insertion port 151A has a lower end portion of the coupling pipe 120 inserted therein. The outer peripheral surface of the lower end portion of the coupling pipe 120 is in contact with the inner peripheral surface of the gasket 157 attached to the insertion port 151A. The inflow portion 151 is housed in the internal space K of the toilet 300.

The ascending passage 153 extends to the downstream side of the storage part 150. The ascending passage 153 is cylindrical. The upstream end of the ascending passage 153 is connected to the lower end portion of the inflow portion 151 along an opening formed backward at the lower portion of the inflow portion 151. The ascending passage 153 communicates with the inflow portion 151. The ascending passage 153 extends diagonally upward facing backward. That is, the ascending passage 153 inclines up toward the downstream side. The length of the ascending passage 153 may be of a length that allows the connecting part 69 of the housing 60 of the breaking-up pump 40 to connect to the downstream end portion of the ascending passage 153. The upper end of the downstream end portion of the ascending passage 153 is lower than the upper end portion of the inflow portion 151 in the up-down direction. The ascending passage 153 is housed in the internal space K of the toilet 300.

As illustrated in FIG. 15, the storage part 150 does not store the wash water W and the like in the standby state prior to executing the toilet wash. Note that there are also cases which the storage part 150 stores water such as the wash water W remaining from a previous round of the toilet wash in the standby state prior to executing the toilet wash. In the toilet 300 of this toilet apparatus 2, the flapper valve 130 closes the discharge port 111A of the toilet bowl part 111 in the standby state prior to executing the toilet wash. As illustrated in FIG. 16, the storage part 150 temporarily stores the waste matter F, the wash water W, and the like in a state prior to the breaking-up pump 40 starting, which is described below.

The connecting part 69 of the housing 60 of the breaking-up pump 40 connects to the downstream end portion of the ascending passage 153 that extends diagonally upward. That is, the breaking-up pump 40 faces the downstream side of the ascending passage 153 and is connected to the downstream end portion that is inclined upward. Therefore, the breaking-up pump 40 has the rotating shaft part 51 of a drive part disposed in a diagonally inclined state along the ascending passage 153. A connection portion between the connecting part 69 of the housing 60 of the breaking-up pump 40 and the downstream end portion of the ascending passage 153 is higher in the up-down direction than the upper end H of the upstream end of the ascending passage 153. The breaking-up pump 40 is provided on the downstream side of the ascending passage 153, and is disposed at a position higher than a lowest end portion L of the storage part 150 in the up-down direction. In this toilet apparatus 2, the downstream end portion of the ascending passage 153 is at a low position so the breaking-up pump 40 can be disposed at a low position. Moreover, the ascending passage 153 is short, so the toilet apparatus 2 can be disposed such that the back end portion of the breaking-up pump 40 does not protrude backward from the back end of the toilet main body 110.

When the toilet wash is executed, this toilet apparatus 2 supplies the predetermined amount of wash water W from the water supply part 20 to the toilet 300, and spouts the wash water W from the spout port of the toilet 300 into the toilet bowl part 111. In one round of the toilet wash, this toilet apparatus 2 spouts, as one example, approximately 1 L of the wash water W from the spout port of the toilet 300. In this toilet apparatus 2, when the toilet wash is executed and the wash water W is spouted into the toilet bowl part 111, the waste matter F, the wash water W, and the like rest on the upper surface of the flapper valve main body 131 of the flapper valve 130, and the discharge port 111A of the toilet bowl part 111 opens by the flapper valve main body 131 rotating downward, and the waste matter F, the wash water W, and the like fall downward from the flapper valve main body 131. When the waste matter F, the wash water W, and the like fall inside the storage part 150 from above the flapper valve main body 131, the flapper valve 130 closes the discharge port 1111A of the toilet bowl part 111. As illustrated in FIG. 16, when the waste matter F, the wash water W, and the like fall inside the storage part 150 and are stored, in this toilet apparatus 2, a water level rises inside the storage part 150, the wash water W and the like flow inside the housing 60 of the breaking-up pump 40, and the inside of the housing 60 of the breaking-up pump 40 takes on a filled state.

When the inside of the housing 60 of the breaking-up pump 40 takes on a filled state, this toilet apparatus 2 starts the rotary drive part 50 of the breaking-up pump 40. Then, the breaking-up pump 40 sucks up the waste matter F, the wash water W, and the like which are retained in the storage part 150 through a suction force of the pump part, and these flow inside the housing 60. In the breaking-up part, the breaking-up pump 40 agitates the wash water W and the like while the breaking-up blade 80 breaks up the solid matter such as the waste matter F inside the housing 60 to form a highly fluid sewage. The breaking-up pump 40 feeds the sewage inside the housing 60 from the outflow port 65 to the discharge tube 90 through a force-feeding force of the pump part. When there is no more of the waste matter F, the wash water W, and the like from the storage part 150, the breaking-up pump 40 stops the rotary drive part 50, and ends the toilet wash. Thereby, this toilet apparatus 2 returns to the standby state prior to executing the toilet wash.

As described above, the toilet apparatuses 1 and 2 of embodiments 2 and 3 include: the toilet bowl parts 11 and 111, the storage parts 30 and 150 for storing the waste matter F as well as the wash water W spouted into the toilet bowl parts 11 and 111, the ascending passages 17 and 153 that extend to a downstream side of the storage part 30 and 150 and are inclined up toward the downstream side, and the pump part provided on the downstream side of the ascending passages 17 and 153 that is disposed at a position higher than the lowest end portion L of the storage parts 30 and 150 in the up-down direction.

In these toilet apparatuses 1 and 2, because the pump part provided on the downstream side of the ascending passages 17 and 153, which are inclined up toward the downstream side, are disposed at a position higher than the lowest end portion L of the storage parts 30 and 150, there is no need for a space to dispose the pump part on an underside of the toilet bowl parts 11 and 111. Therefore, these toilet apparatuses 1 and 2 are able to suppress enlargement of an overall height dimension. These toilet apparatuses 1 and 2 shorten a distance from the storage parts 30 and 150 to the pump part, which allows a small amount of the wash water W to be able to drive the pump part, so water can be saved.

In the toilet apparatus 1 of embodiment 2, the connecting portion of the pump part and the ascending passage 17 is higher than the upper end H of the upstream end of the ascending passage 17 in the up-down direction. This toilet apparatus 1 can form a water seal via the wash water W stored in the storage part 30.

The pump part of the toilet apparatus 1 of embodiment 2 is connected to the downstream end portion 13D of the ascending passage 17 that extends in the horizontal direction facing backward. This toilet apparatus 1 is able to suppress enlargement of a height dimension of the pump part connected to the ascending passage 17.

The pump part of the toilet apparatus 2 of embodiment 3 faces the downstream side of the ascending passage 153 and is connected to the downstream end portion that is inclined upward. This toilet apparatus 2 is able to suppress enlargement of the overall front-back dimension of the pump part connected to the ascending passage 153.

The toilet apparatuses 1 and 2 of embodiments 2 and 3 are provided on a side further upstream than the pump part and include the breaking-up part for breaking up the waste matter F. In these toilet apparatuses 1 and 2, the breaking-up part is provided on a side further upstream than the pump part, so the waste matter F is broken up and the wash water W and the like are agitated to form a highly fluid sewage in the breaking-up part, which allows the pump part to favorably feed out the sewage.

The breaking-up part of embodiments 2 and 3 is provided with the pump part in an integral manner. These toilet apparatuses 1 and 2 are able to suppress enlargement of an overall height dimension compared to when the breaking-up part and the pump part are provided separately.

The pump parts of embodiments 2 and 3 have the rotating shaft part 51 and the discharge fins 70 that are attached to and rotate with the rotating shaft part 51, and the breaking-up part has the breaking-up blade 80 that is attached to and rotates with the rotating shaft part 51. In these toilet apparatuses 1 and 2, the discharge fins 70 and the breaking-up blade 80 are able to be driven by the same rotary drive part 50. Therefore, these toilet apparatuses 1 and 2 are able to suppress enlargement of an overall height dimension compared to when the discharge fins 70 and the breaking-up blade 80 have separate rotary drive parts 50.

The toilet apparatus 2 of embodiment 3 includes a flapper valve 130 that opens and closes the discharge port 11*l* A formed at a lower portion of the toilet bowl part 111, and the storage part 150 is provided on a side further downstream than the flapper valve 130. This toilet apparatus 2 is able to drive the pump part using less of the wash water W to feed out sewage, so more water can be saved.

A first toilet apparatus is not limited to embodiment 1 as described according to the above and the drawings. For example, embodiments such as the following are also included in the technical scope of the present disclosure.

(1) In differing from embodiment 1, there may be no water supply tank provided, and wash water may be spouted from a water supply source, through an opening and closing valve, and directly into the toilet bowl.

(2) In differing from embodiment 1, the breaking-up part may be configured to drive when the inflow port is blocked by the wash water for washing the toilet bowl. In this case, for example, it is conceivable that when a water level sensor detects that a water surface of sewage is positioned above an upper end of the inflow port, a water level detection signal is output to the control part, and the motor is rotationally driven. According to this configuration, the breaking-up part is able to favorably break up solid matter contained in sewage without idling.

(3) In differing from embodiment 1, the control part may rotationally drive the motor after an operation detection signal is input a plurality of times from the operation detection part. That is, the motor may be rotationally driven to drive the breaking-up part once a plurality of round's worth of sewage is stored inside the buffer tank.

(4) In differing from embodiment 1, as illustrated in FIG. 6, an end edge on the buffer tank 18 side of the breaking-up blades 12D of the breaking-up wing 12B may be disposed on a virtual surface Vs spreading on the same surface as an inner surface of the buffer tank 18.

(5) In differing from embodiment 1, the buffer tank may be disposed behind and below the discharge port of the toilet bowl. In this case, it is conceivable that a lower end opening of the connecting member and an upper end opening of the buffer tank communicate through a discharge passage that inclines downward going backward. In this case, it is preferable that an angle of inclination of the discharge passage with respect to the vertical direction be an angle generally smaller than 45 degrees (that is, an angle more upright than 45 degrees).

(6) In differing from embodiment 1, the water supply tank and the drainage tank may be arranged and disposed vertically.

(7) In differing from embodiment 1, the partition wall may extend to the ceiling of a restroom and serve as a back wall of the restroom.

(8) In differing from embodiment 1, the buffer tank as a whole and a portion of the breaking-up part may be configured to be positioned inside the outer edge of the toilet in a plan view as seen from above.

(9) In differing from embodiment 1, the form of the flapper valve may be dish-like, having an outer peripheral edge portion rising over an entire periphery thereof.

(10) In differing from embodiment 1, a side surface on the right side, a side surface on the left side, and a side surface below an upper end of the buffer tank (that is, the side surfaces) may communicate with an inflow port of the breaking-up part.

(11) In differing from embodiment 1, a breaking-up wing 112B having a form such as illustrated in FIG. 7 is also acceptable. Specifically, the breaking-up wing 112B has a plate part 112F that widens in three divided parts orthogonal to the rotating shaft 12A, and three breaking-up blades 112D that extend cylindrically toward the buffer tank from each tip end portion of the plate part 112F that widens in three divided parts.

(12) In differing from embodiment 1, a toilet apparatus 200 having a form such as illustrated in FIG. 8 is also acceptable. Specifically, a configuration may have the flapper valve 30B descend due to a weight of wash water and waste matter. In this case, a configuration is conceivable wherein, for example, a wash switch 110C using a well-known push button or the like is provided above the toilet 10, and a wash signal D2 is output toward the control part 72 when the wash switch 10C is pressed. The control part 72 stops operation of the motor M after being rotationally driven for a predetermined amount of time based on the wash signal D2, the water supply pump 16 operates, and a predetermined amount of water is supplied from the water supply tank 15 to the toilet bowl 10A. According to this configuration, the configuration for opening and closing the discharge port 10M can be simplified.

A second toilet apparatus is not limited to embodiments 2 and 3 as described according to the above and the drawings. For example, embodiments such as the following are also included in the technical scope.

(1) In the ascending passage 17 of the toilet 10 of embodiment 2, the downstream end portion 13D extends in a horizontal direction facing backward. In contrast, as illustrated in FIG. 17 and FIG. 18, an ascending passage 213 of a toilet 210 may, as a whole including a downstream end portion thereof, incline up toward the downstream side. In this case, the connecting part 69 of the housing 60 of the breaking-up pump 40 is connected to the downstream end portion of the ascending passage 213 inclined up toward the downstream side, which, as illustrated in FIG. 18, allows the inside of the housing 60 of the breaking-up pump 40 to fill from less of the wash water W and drive the breaking-up pump 40. In FIG. 17 and FIG. 18, the same configurations as in the toilet apparatus 1 of embodiment 2 are given the same reference numerals.

(2) The breaking-up pump 40 of embodiments 2 and 3 has the breaking-up blade 80 and the discharge fins 70, separately. In contrast, as illustrated in FIG. 19, a breaking-up pump 140 may not have the discharge fins 70 and the breaking-up blade 80 separately, and may have a plurality of discharge fins 170 equipped with a breaking-up function for breaking up the waste matter F. In FIG. 19, the same configurations as in the breaking-up pump 40 of embodiment 2 are given the same reference numerals.

In this case, twenty of the discharge fins 170 are provided, arranged on an outer peripheral edge portion of a circular plate 171. As illustrated in FIG. 20, the circular plate 171 has a first notch side 171A that is notched facing from the outer peripheral edge to the center, twenty of which are formed at equal intervals in the peripheral direction, and a second notch side 171B that is notched parallel to the outer peripheral edge and is continuous with each first notch 171A. The second notch side 171B extends from one end portion continuous with the first notch side 171A until in front of the first notch side 171A adjacent thereto. Each of the discharge fins 170 is bent at a bend line X—a virtual straight line extending in a radial direction from the other end portion of the second notch side 171B toward the outer peripheral edge—and is formed inclining backward toward the first notch side 171A side that extends continuously with the one end portion of the second notch side 171B.

The circular plate 171 provided with these discharge fins 170 arranged on the outer peripheral edge portion thereof rotates along with the rotating shaft part 51, whereby the breaking-up pump 140 agitates wash water W and the like to form a highly fluid sewage while breaking up the solid matter such as the waste matter F inside the housing 60, which can be fed out from the outflow port 65 inside the housing 60 to the discharge tube 90.

(3) The toilet apparatus may be a movable toilet such as a vehicle toilet or a portable toilet.

(4) The toilet apparatus of embodiments 2 and 3 includes the breaking-up part. In contrast, the toilet apparatus may not include a breaking-up part.

(5) The toilet apparatus of embodiments 2 and 3 is provided with the breaking-up part and the pump part in an integral manner. In contrast, the breaking-up part and the pump part may be separate.

(6) The toilet of embodiment 3 includes a flapper valve. In contrast, the toilet may not include a flapper valve.

(7) The flapper valve of the toilet of embodiment 3 is mechanical. In contrast, a flapper valve of the toilet may be electrically driven.

(8) The discharge fins and the breaking-up blade are not limited to the forms in embodiments 2 and 3, and may be other forms.

The invention claimed is:

1. A toilet apparatus comprising a toilet comprising a toilet bowl having an opening at a bowl lower end;

a flapper valve for opening and closing the bowl opening;

a buffer tank having an upper end provided below the flapper valve;

a breaking-up part for breaking up waste matter stored in the buffer tank;

a conveyance pump; and a motor, wherein the toilet is configured to be positioned on an installation surface, the breaking-up part comprises an inflow port connected to and in communication with a buffer tank lower end, the conveyance pump is positioned adjacent to and downstream of the breaking-up part, the motor is positioned adjacent to and downstream of the conveyance pump, the inflow port is submerged below a water surface when wash water for washing the toilet bowl is stored in the buffer tank, the buffer tank upper end is configured to be positioned above the installation surface, the buffer tank lower end is configured to be positioned below the installation surface, and the breaking-up part, the conveyance pump, and the motor are configured to be positioned below the installation surface.

2. The toilet apparatus according to claim 1, wherein the buffer tank is configured to store waste matter that passes through the bowl opening into the buffer tank.

3. The toilet apparatus according to claim 1, comprising a connecting member connected to the toilet bowl lower end and the buffer tank upper end, the connecting member comprising the flapper valve.

4. The toilet apparatus according to claim 1, wherein the breaking-up part is connected to a buffer tank back side.

5. The toilet apparatus according to claim 1, comprising a drainage tank, wherein the conveyance pump is configured to convey broken up waste matter from the breaking-up part downstream to the drainage tank.

6. The toilet apparatus according to claim 5, wherein a rotating shaft of the breaking-up part and a rotating shaft of the conveyance pump are coaxial.

7. The toilet apparatus according to claim 5, wherein a drainage tank upper end is at a position higher than that of the flapper valve.

8. The toilet apparatus according to claim 7, further comprising a water supply tank for storing wash water for washing the toilet bowl, wherein the water supply tank and the drainage tank are positioned behind the toilet.

9. The toilet apparatus according to claim 1, wherein the buffer tank and at least a portion of the breaking-up part are positioned inside a toilet outer edge in a plan view as seen from above.

10. The toilet apparatus according to claim 1, comprising a cylindrical gasket connected to the bowl opening at the bowl lower end.

11. The toilet apparatus according to claim 1, wherein the breaking-up part is configured to drive when the inflow port is submerged below the water surface.

12. The toilet apparatus according to claim 1, wherein the breaking-up part comprises a rotating shaft coupled to a breaking-up wing, the breaking-up wing having a plate part and two blades angled from the plate part towards the buffer tank.

13. The toilet apparatus according to claim 1, wherein the motor is electrically connected to and controlled by a control part.

* * * * *